United States Patent [19]

Sartorio

[11] Patent Number: 4,634,359

[45] Date of Patent: Jan. 6, 1987

[54] PROCESS FOR THE MANUFACTURE OF ELEMENTS IN THE FORM OF INSULATED PREPACKED BLOCKS OPERATING AS DISPOSAL CAISSON FOR RECEIVING THE LOAD BEARING MIXTURES AND PRODUCING INNER DUCTS, SUCH AS SEATS OF SERVICES, IN BUILDING ERECTION

[76] Inventor: Sergio Sartorio, Via Medeghino, 7, 20141 Milano, Italy

[21] Appl. No.: 641,932

[22] Filed: Aug. 20, 1984

Related U.S. Application Data

[63] Continuation of Ser. No. 250,220, Apr. 2, 1981, abandoned.

[30] Foreign Application Priority Data

Apr. 2, 1980 [IT] Italy ..... 21133 A/80
Mar. 23, 1981 [IT] Italy ..... 20655 A/81

[51] Int. Cl.[4] ..... B28B 1/16; B28B 5/02; B28B 7/04; B28B 7/36

[52] U.S. Cl. ..... 425/89; 249/84; 249/85; 249/115; 249/158; 249/161; 264/253; 425/115; 425/121

[58] Field of Search ..... 249/115, 158, 161, 84, 249/85; 425/224, 225, 115, 329, 121, 89; 264/253

[56] References Cited

U.S. PATENT DOCUMENTS 962,303 6/1910 Bragstad ..... 249/85
1,562,707 11/1925 Lake ..... 264/253
2,688,175 9/1954 Billner ..... 264/253 X

FOREIGN PATENT DOCUMENTS 1406028 6/1965 France .
1549369 11/1968 France .

*Primary Examiner*—Jan Silbaugh
*Attorney, Agent, or Firm*—Fleit, Jacobson, Cohn & Price

[57] ABSTRACT

Apparatus for the manufacture of insulating building elements including at least one inner insulating panel and two outer spaced apart concrete slabs having well trimmed outer surfaces, and reinforcements to space apart the two slabs thus forming a continuous cavity. The apparatus rests on a working plane and includes a pair of opposed side boards and two vertically spaced rectangular frames supported by said side boards in superimposed parallel relationship. Connecting devices extend between the frames for positioning each one of the frames in adjustably spaced apart relationship at the level of each concrete slab, and define therebetween an opening through which reinforcements can be introduced or removed.

13 Claims, 72 Drawing Figures

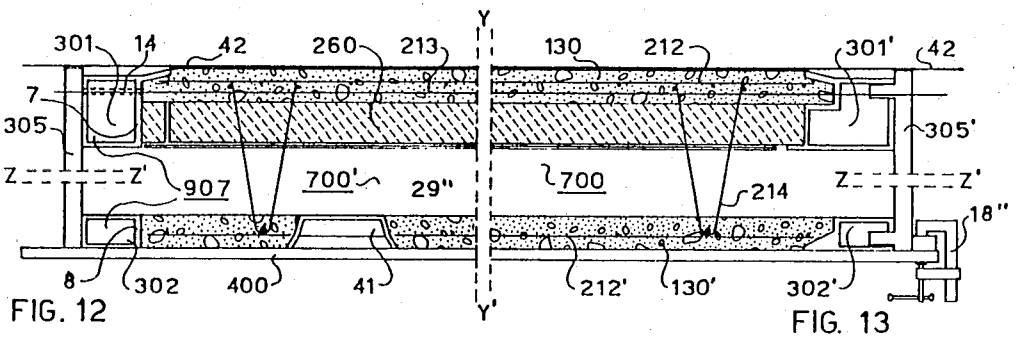
FIG. 13
FIG. 12
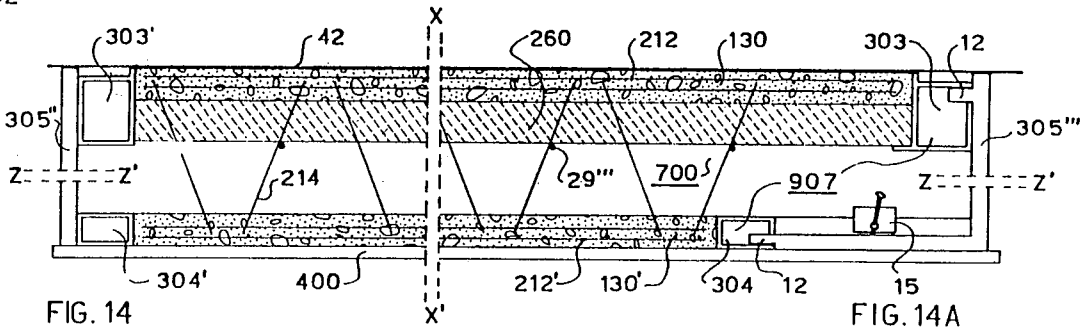
FIG. 14A
FIG. 14
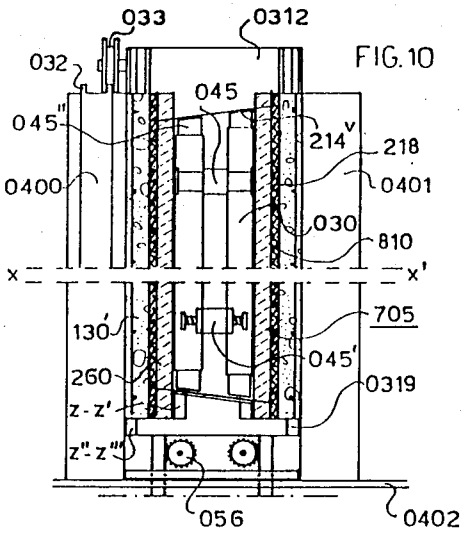
FIG. 10
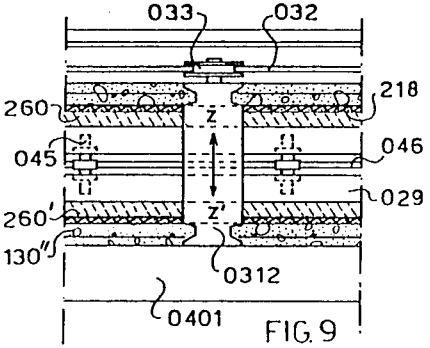
FIG. 9

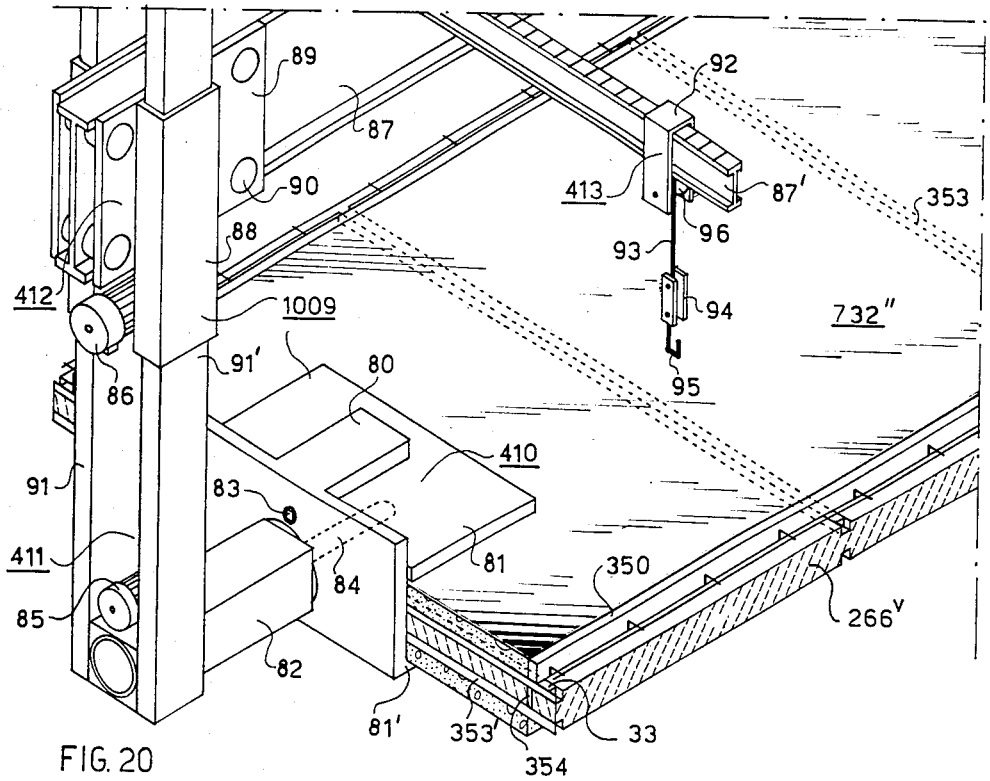
FIG. 20
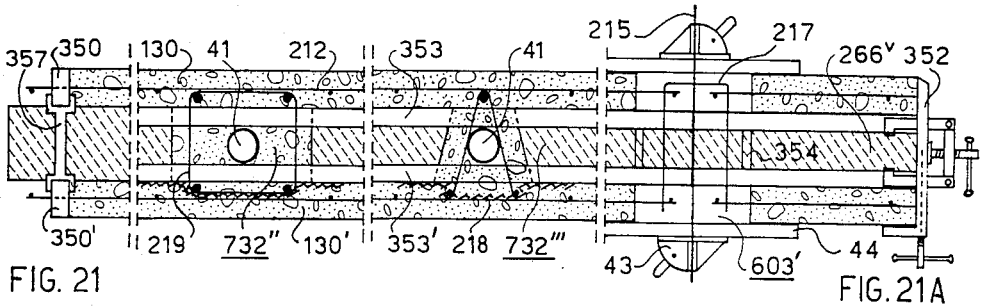
FIG. 21
FIG. 21A
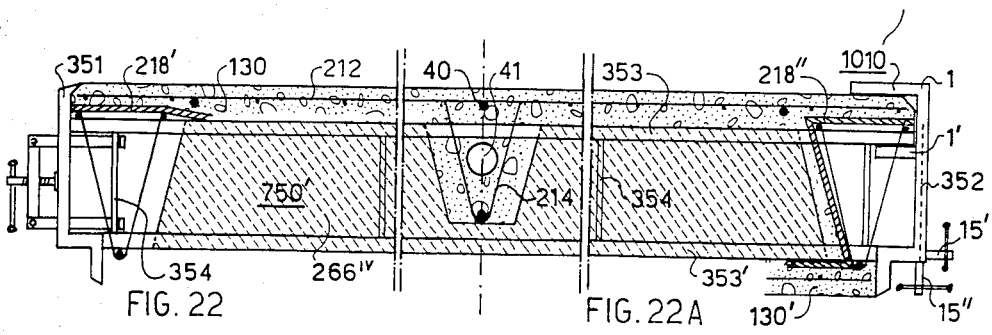
FIG. 22
FIG. 22A

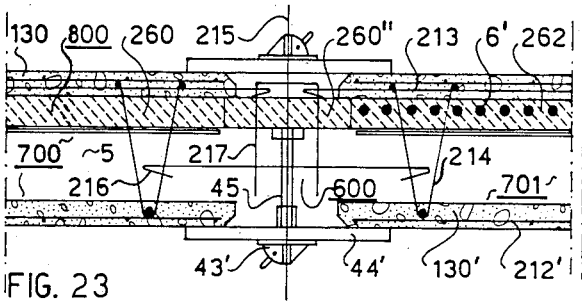
FIG. 23
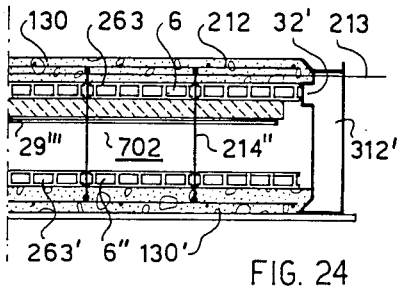
FIG. 24
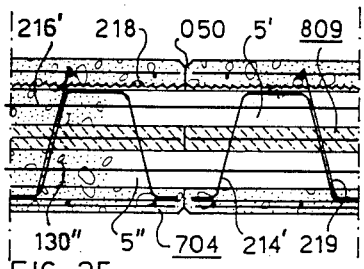
FIG. 25
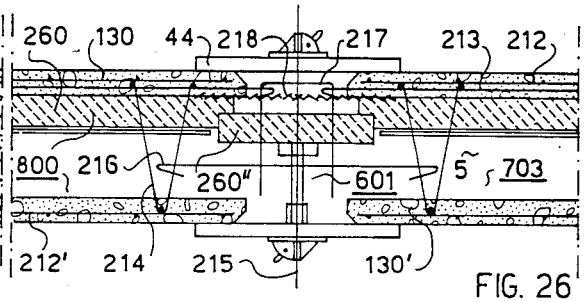
FIG. 26
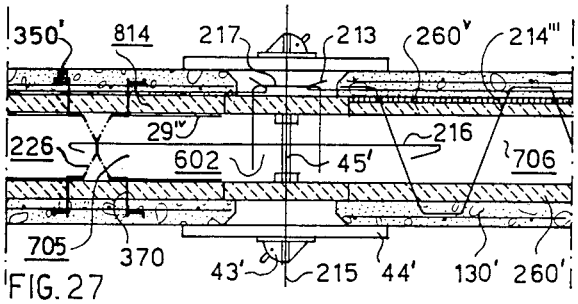
FIG. 27
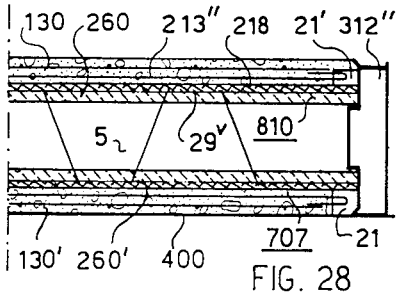
FIG. 28
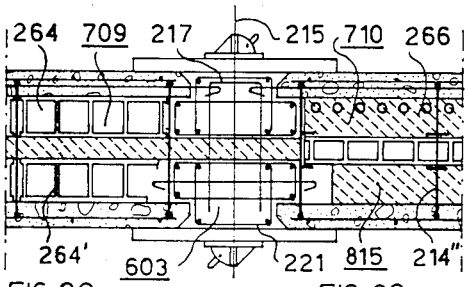
FIG. 29
FIG. 30
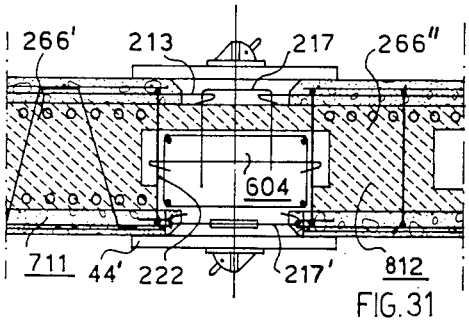
FIG. 31

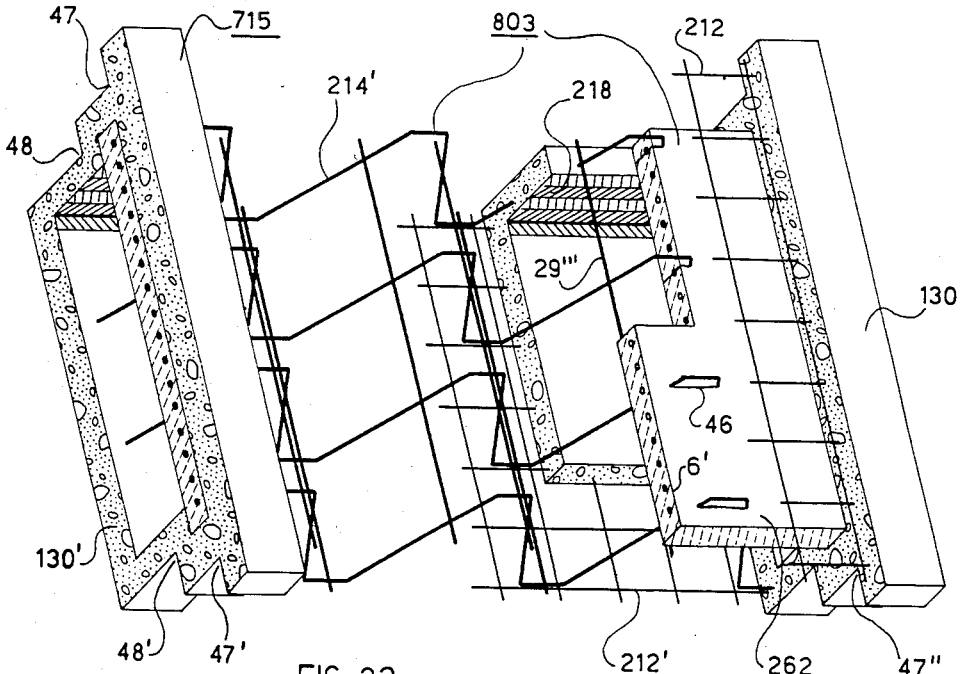
FIG. 32
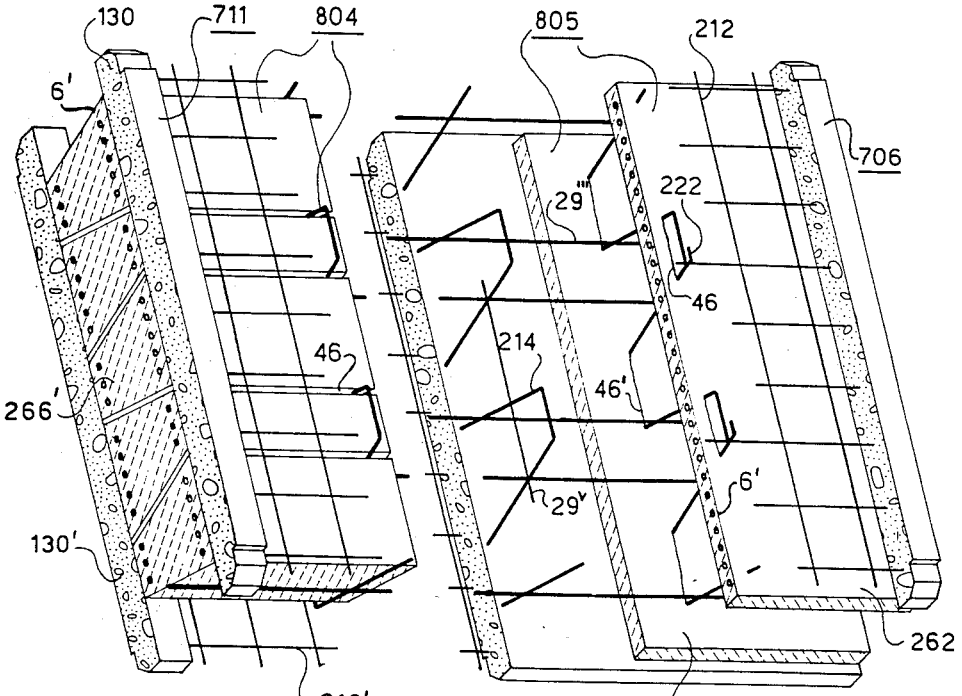
FIG. 33
FIG. 34

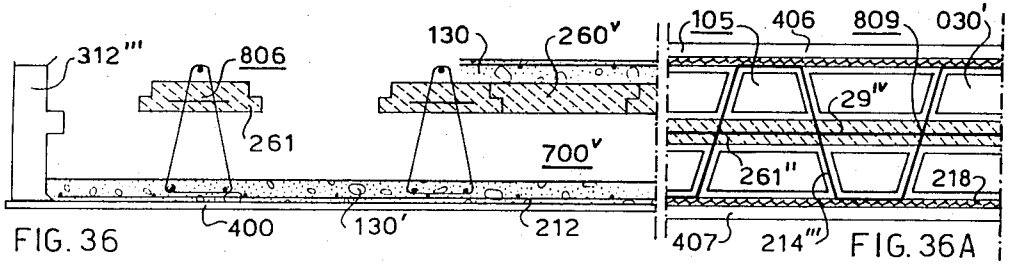
FIG. 36A
FIG. 36
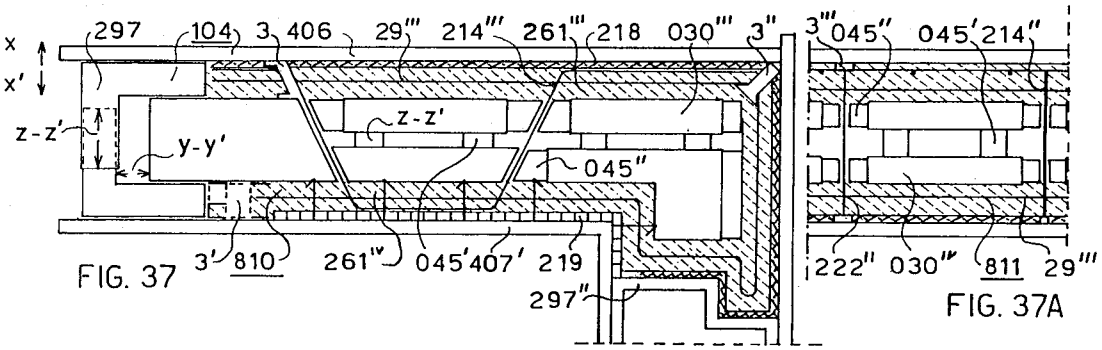
FIG. 37A
FIG. 37
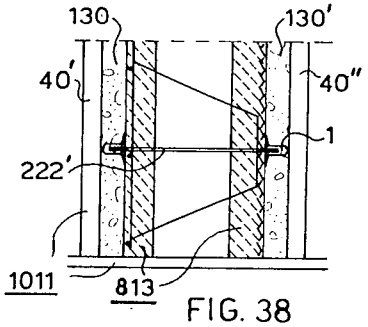
FIG. 38
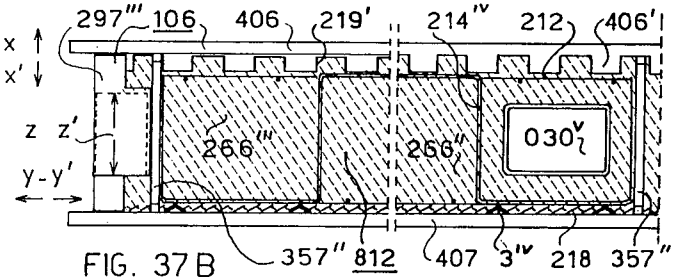
FIG. 37B
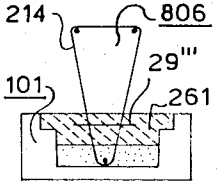
FIG. 35
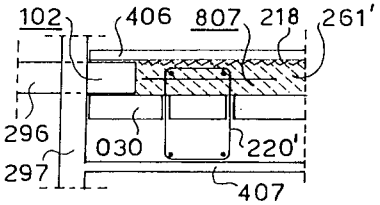
FIG. 35A
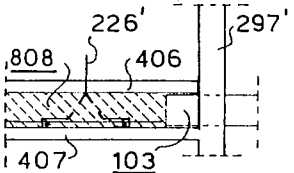
FIG. 35B

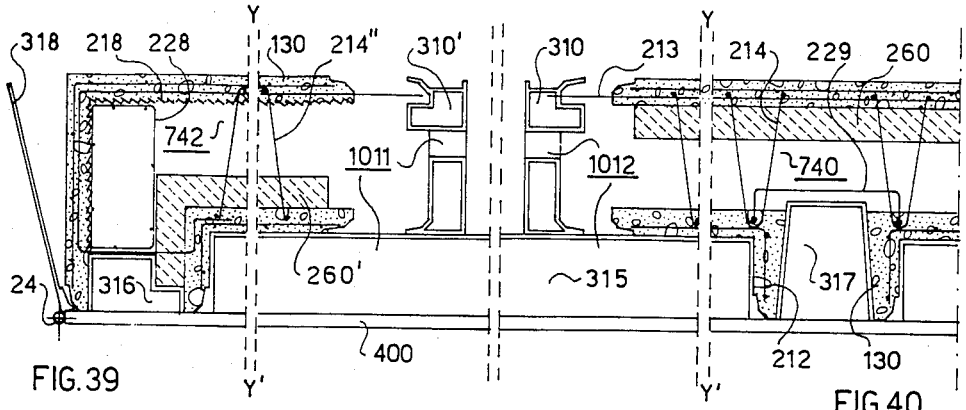
FIG. 39
FIG. 40
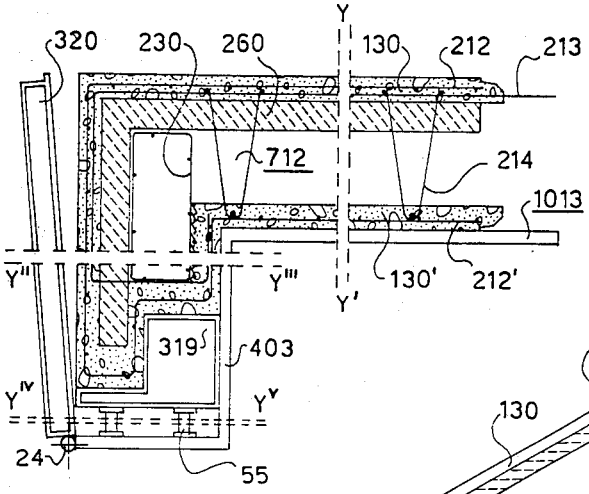
FIG. 41
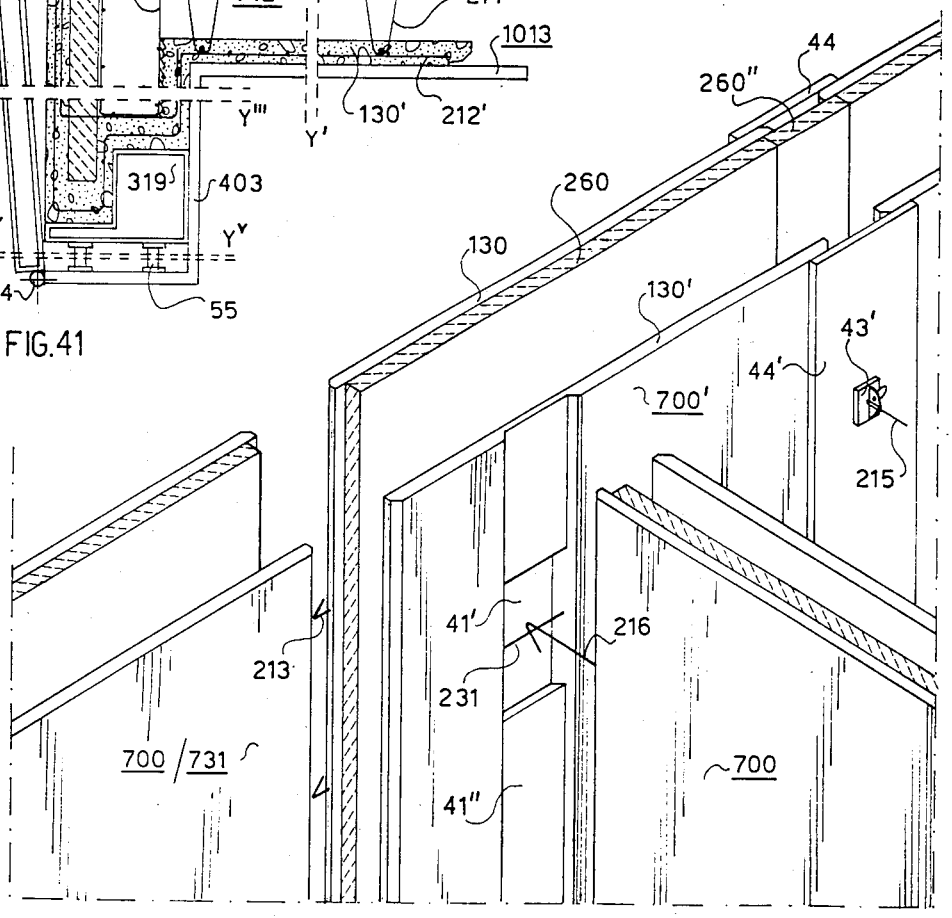
FIG. 42

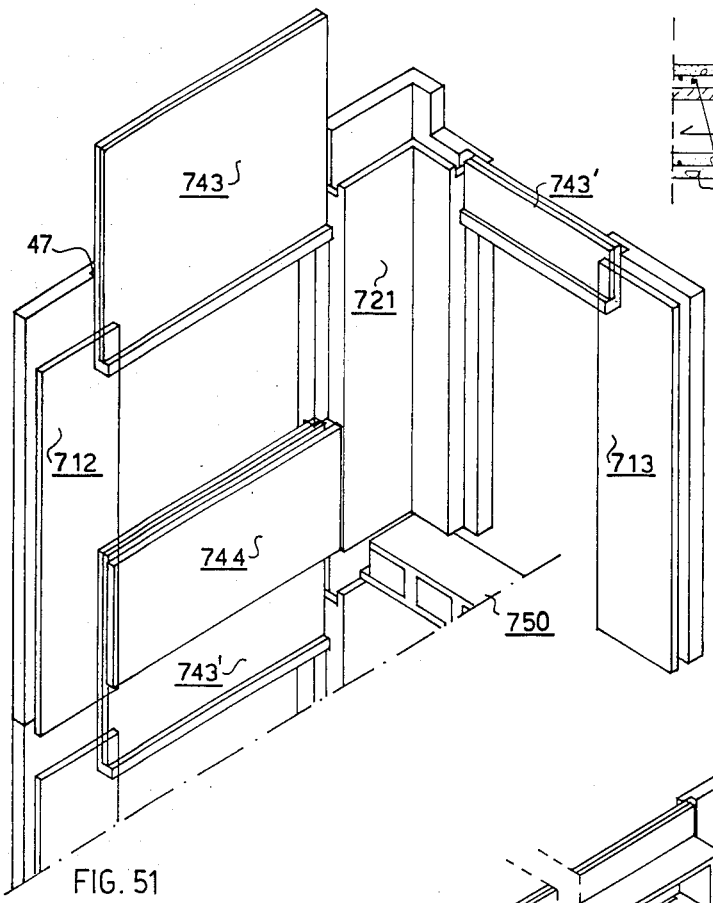
FIG. 51
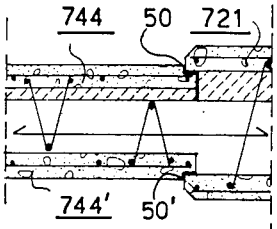
FIG. 52
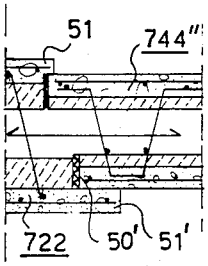
FIG. 53
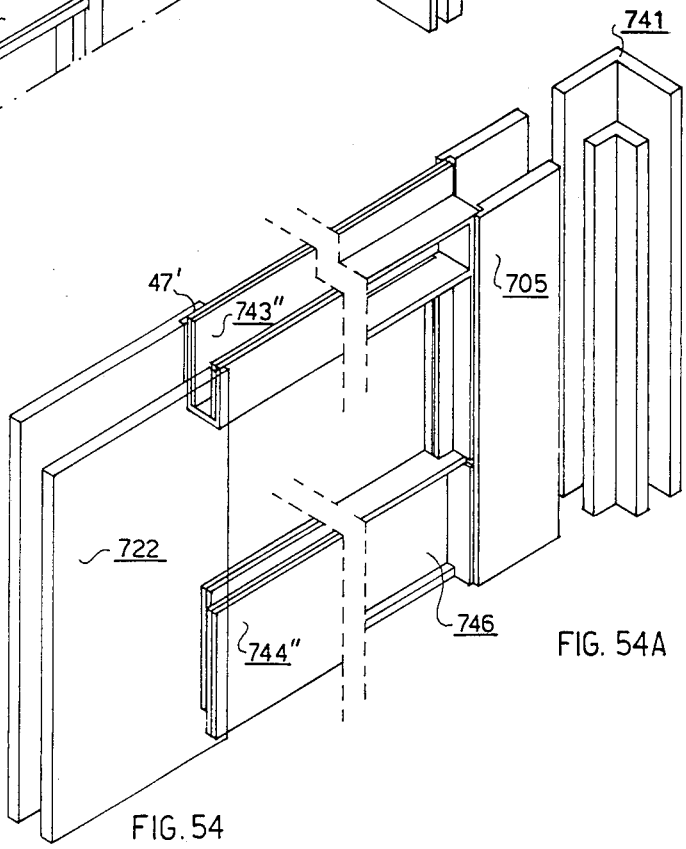
FIG. 54A
FIG. 54

PROCESS FOR THE MANUFACTURE OF ELEMENTS IN THE FORM OF INSULATED PREPACKED BLOCKS OPERATING AS DISPOSAL CAISSON FOR RECEIVING THE LOAD BEARING MIXTURES AND PRODUCING INNER DUCTS, SUCH AS SEATS OF SERVICES, IN BUILDING ERECTION

This application is a continuation, of application Ser. No. 250,220, filed Apr. 2, 1981, now abandoned.

Assembly processes are known for the manufacture of building elements comprising spaced apart double concrete slabs with reinforcements which are connected and inserted in suitable inwardly projecting seats. Other configurations foresee the manufacture of an outer cured reinforced concrete slab which is turned over by 180° together with its complete mould on to a still fresh concrete material so that the reinforcements penetrate it.

These known structures require long manufacturing times, difficult assembly for which cumbersome equipment is necessary. We experienced other problems when structures having previously predetermined dimensions have to be made. It is also difficult to obtain the accurate parallelism of the slabs.

This invention is directed to a novel and improved process for simplifying the manufacture of insulated hollow building elements having a variety of spaced apart parallel surfaces, forming a cavity. Said insulated building elements are designed to receive in their cavity a continuous casting forming well finished load bearing walls. They are prefabricated in a factory or in a building yard by using according to the builder's choice automatic, semiautomatic or manual processes. They comprise the use of components allowing all the dimensional adaptations required by the planner both in manufacture and when creating the building. The use of prefabricated special outfits for erecting the building with accuracy and rapidity are also provided, assuring efficiency and low cost. The production needs easy manufacturing operations, this is carried out continuously with rapidity and without disturbing the lay out and the dimensions of the positioned equipment.

The prefabricated hollow elements, thus obtained assume protection against cold or heat, owing to the insulating materials assembled in rigid slabs. These slabs are moulded with the incorporation of reticular connecting reinforcements which hold spaced apart the slabs preferably comprising binding mixtures which, upon settling, have high strength and finish characteristics. The invention also comprises the manufacture of special auxiliary outfits, factory made in standardized form comprising reveals and the like, for rapid insertion of window and door frames, straight (90°) inverted (270°) insulated hollow corners. This considerably aids the assembly of the basic walls, T-junction for walls. A special equipment is also provided for the manufacture of floors and light prefabricated walls used as inner building partitions.

The new equipment allows the rapid construction in a building yard of load bearing front walls fitted with windows, floors, inner partition walls and doors, the whole firmly bound with continuous castings of reinforced concrete.

The joints between adjacent building elements are carried out by a continous connection of the inner reinforcements together with resilient concealed adapters capable of absorbing expansions.

Particularly, the assembly system of the prefabricated elements by means of connecting irons and jacks allows the desired variation of the dimensions of the building to be erected.

The accompanying drawings show different embodiments of the invention for the manufacture of the building elements in different forms, obtained by automatic, semi-automatic or manual processes. They also show how these panels are positioned during building erection.

More particularly:

Figure 3:
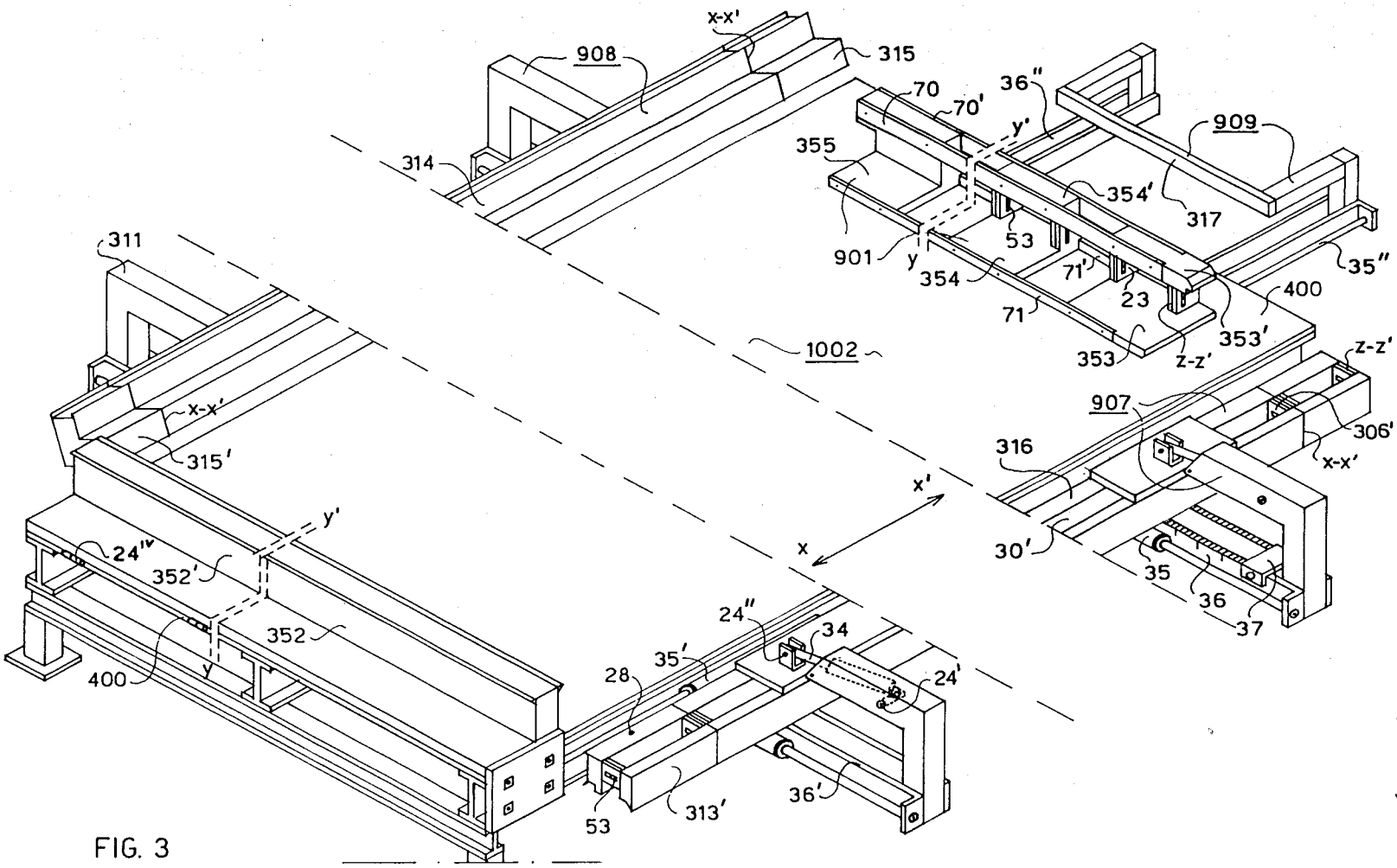
FIG. 3 is a view showing an apparatus 1002, with piston devices allowing the manufacture of the building elements with the required complete dimensional flexibility.
Figure 4:
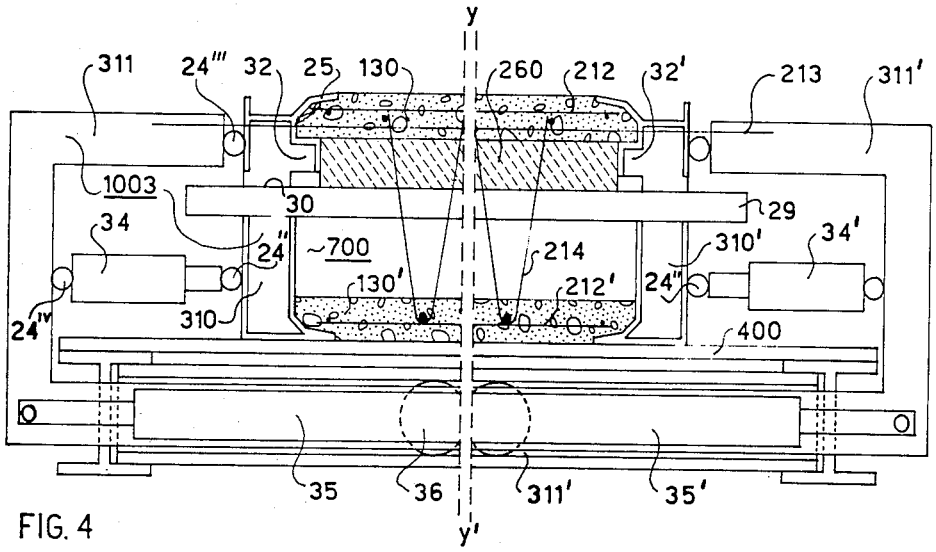
FIG. 4 is a cross-sectional view of pneumatic or hydraulic handling equipment 1003, which is a variant of the apparatus shown in FIG. 3.
Figure 5:
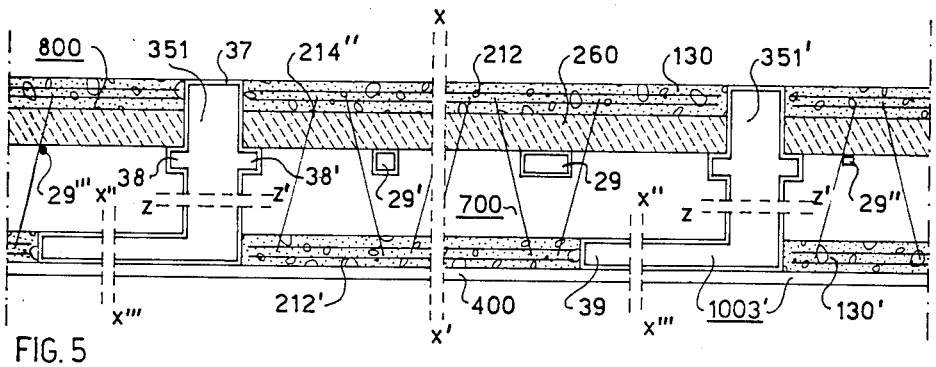
Figure 6:
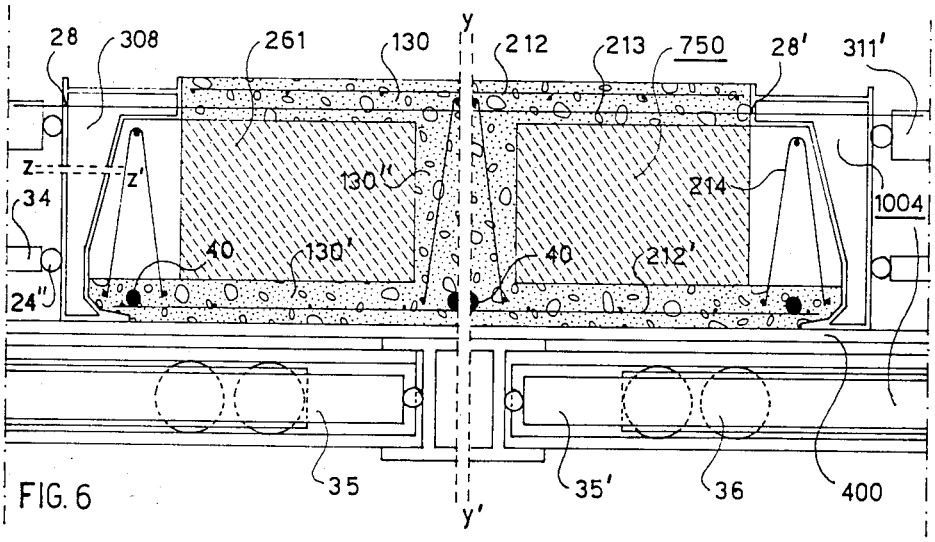
Figure 7:
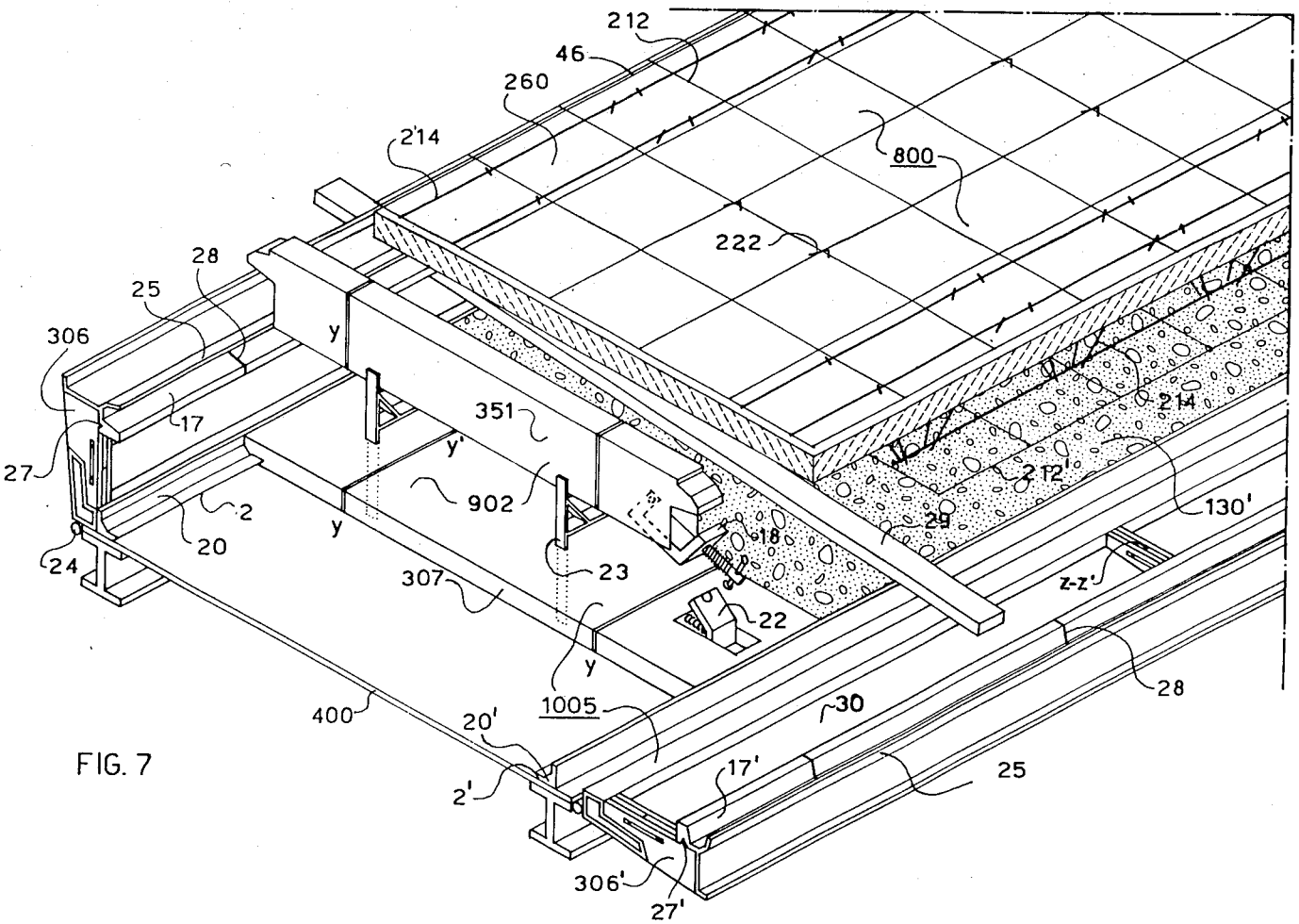
Figure 8:
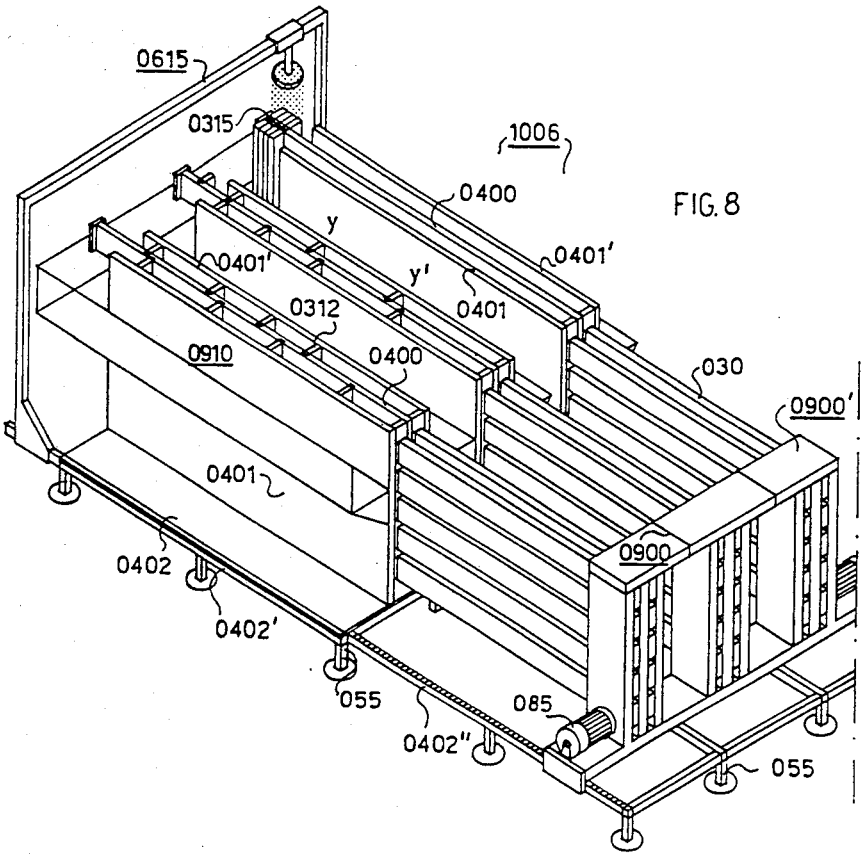
Figure 11:
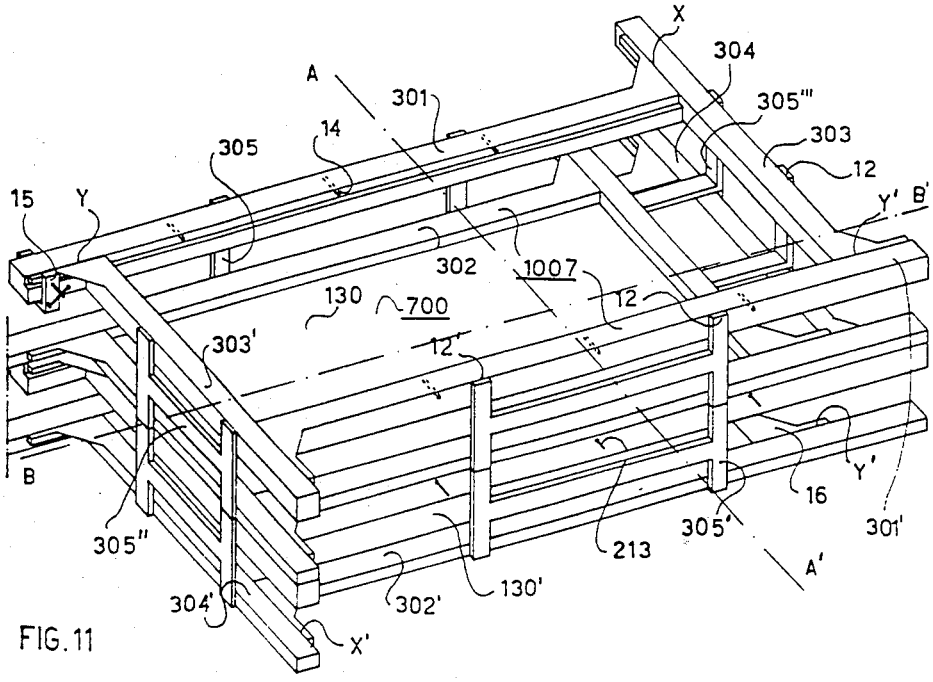
Figure 16:
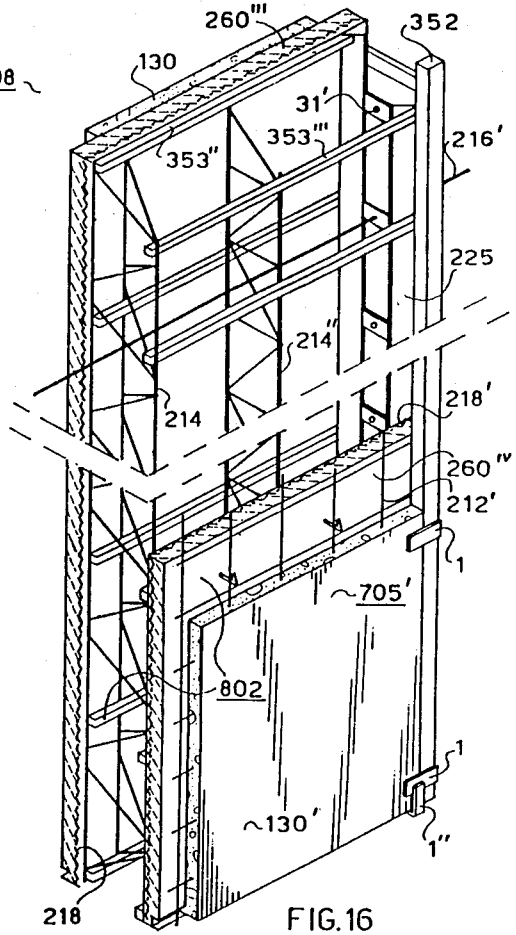
Figure 15:
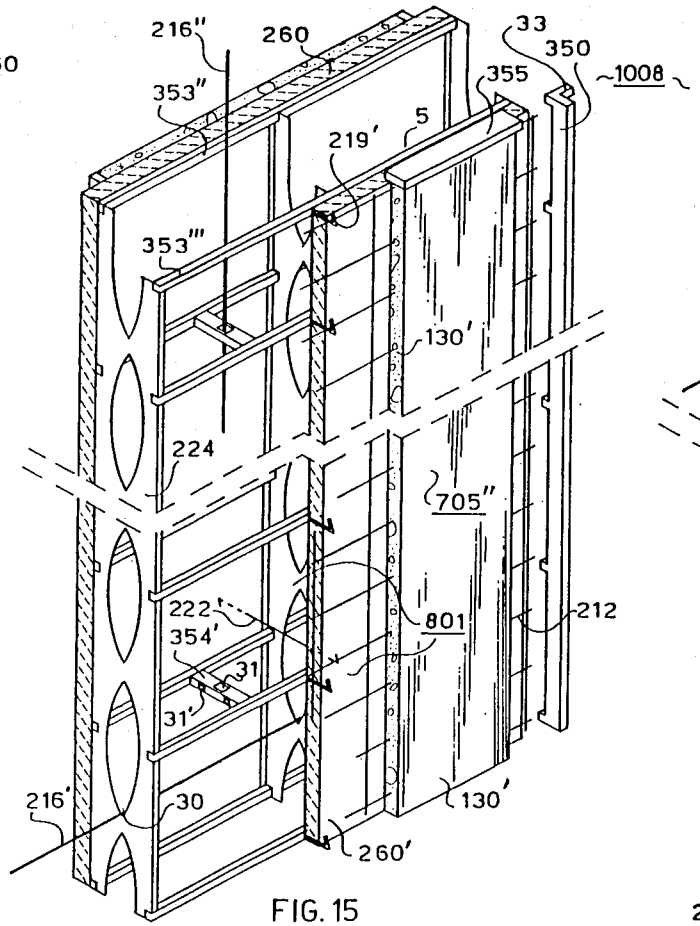
Figure 17:
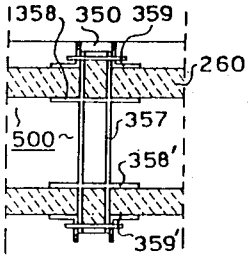
Figure 18:
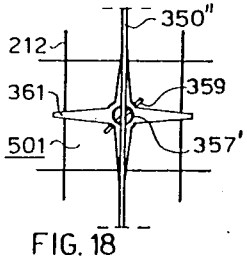
Figure 19:
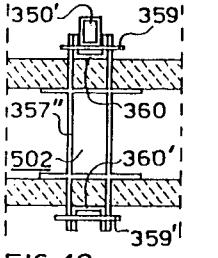
Figure 43:
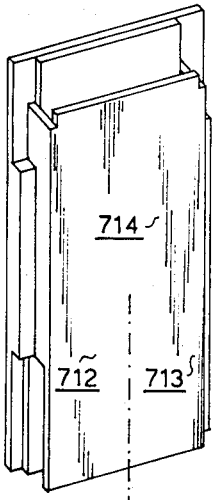
Figure 44:
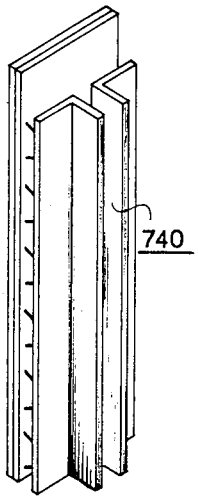
Figure 45:
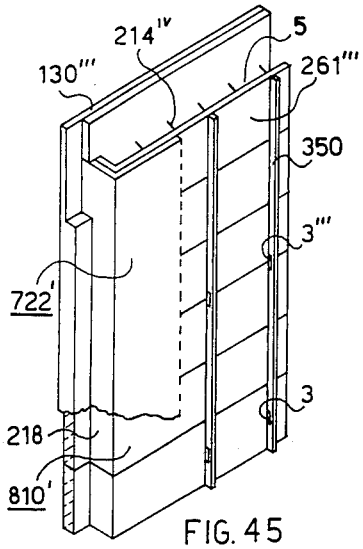
Figure 46:
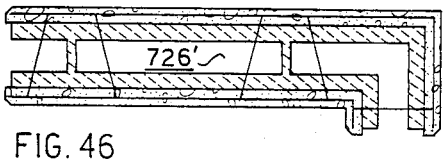
Figure 47:
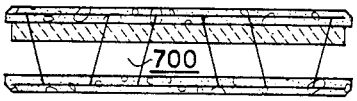
Figure 55:
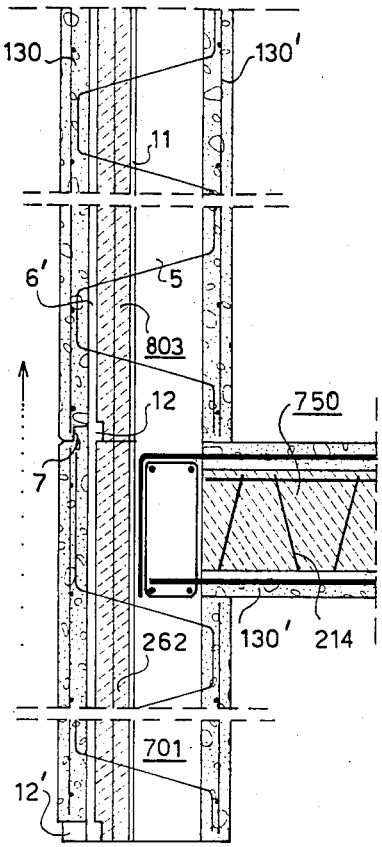
Figure 56:
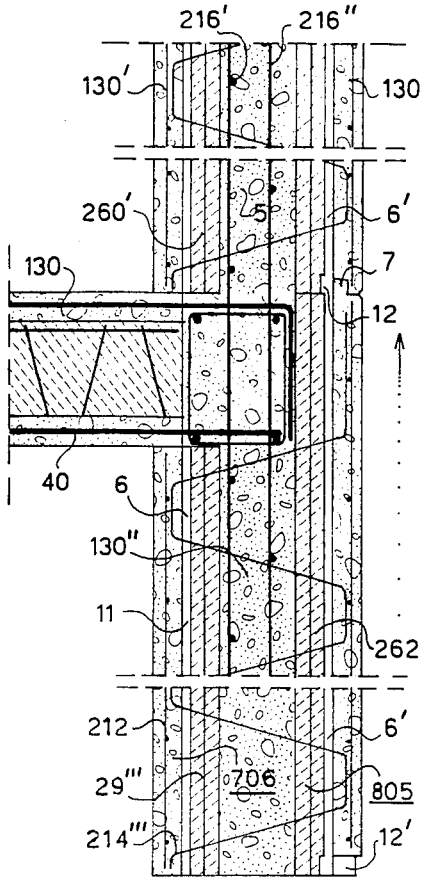
Figure 57:
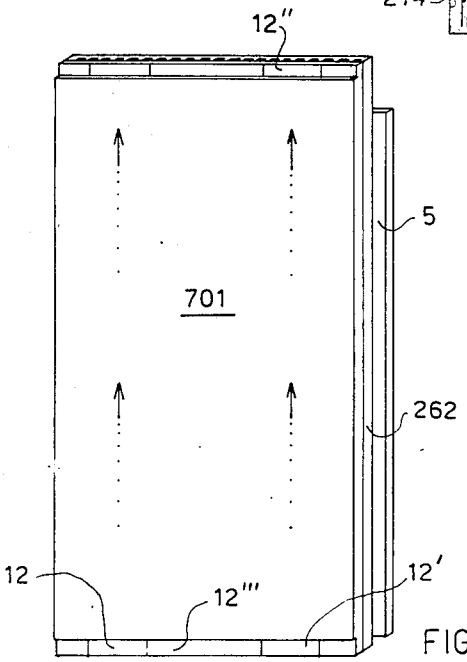
Figure 58:
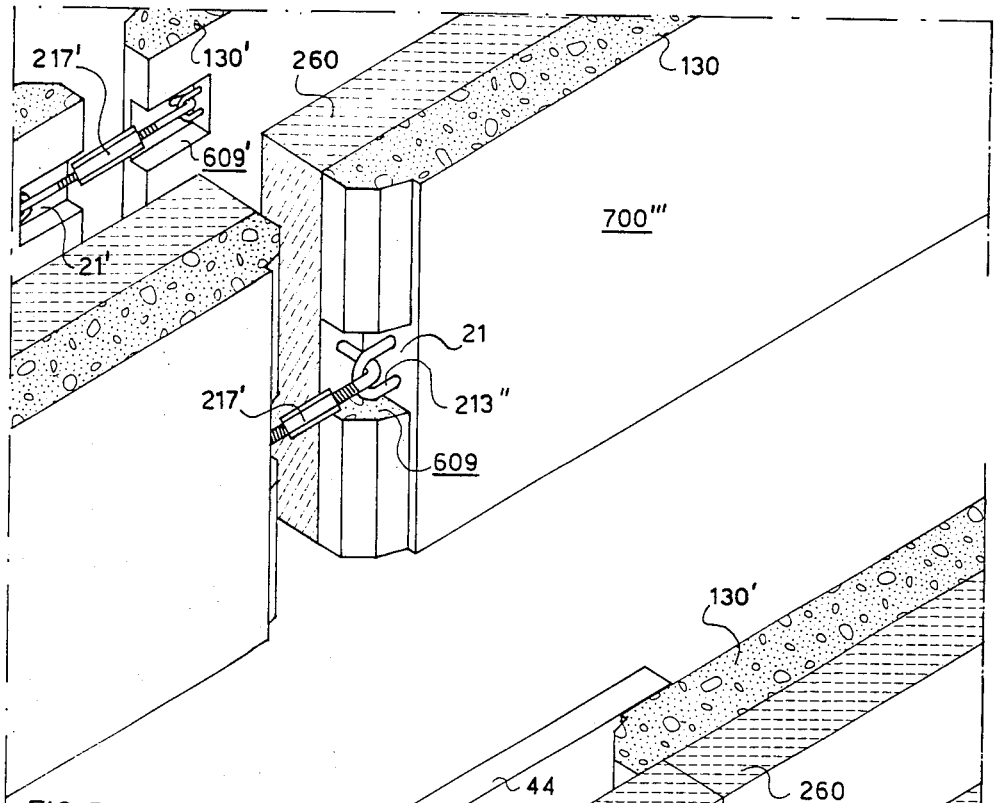
Figure 59:
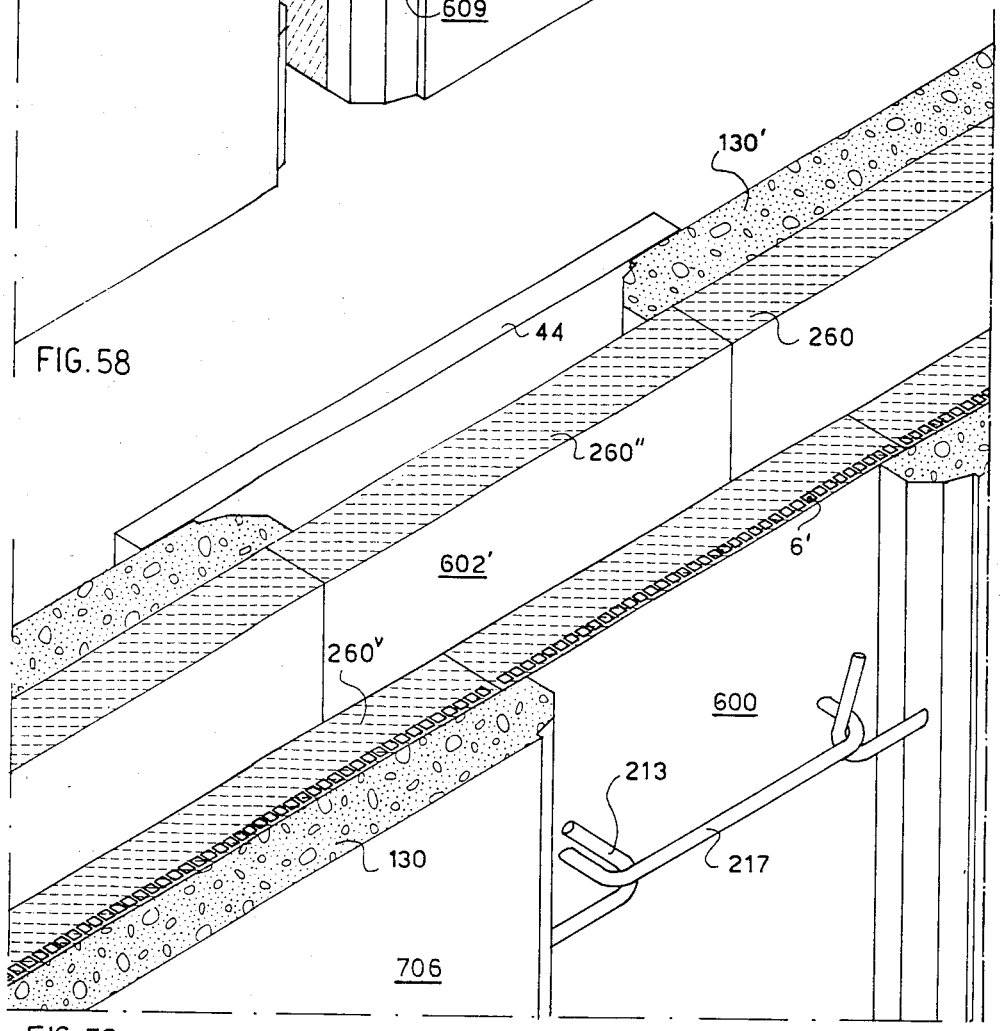
Figure 60:
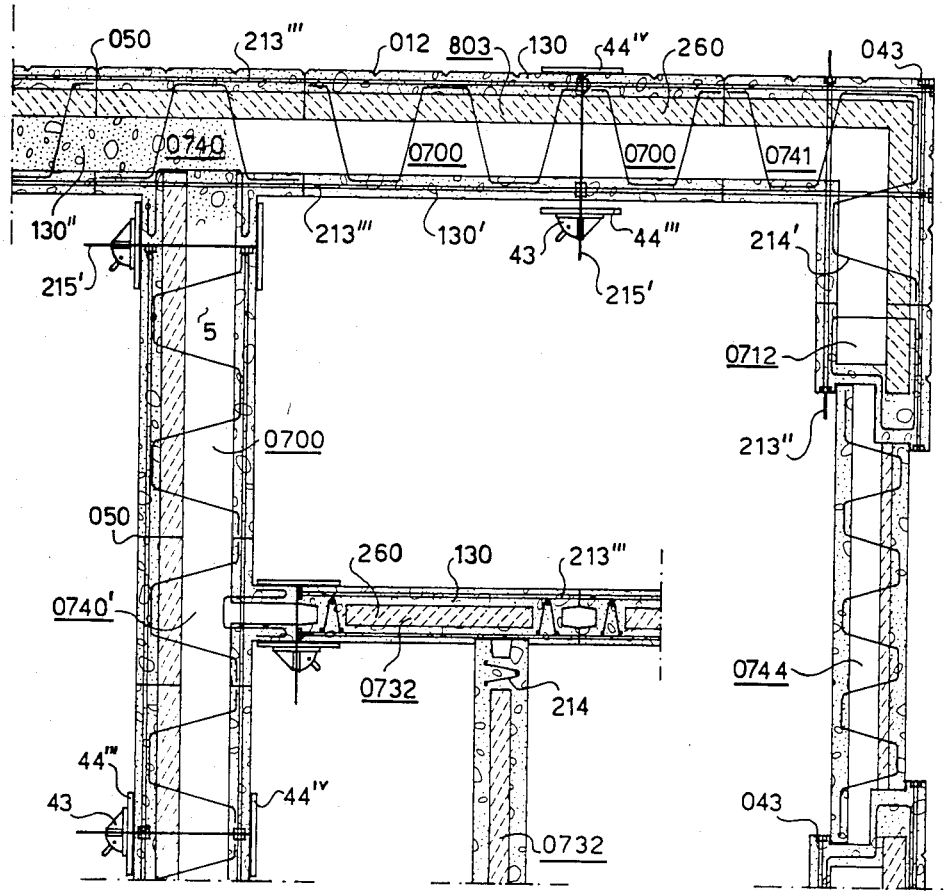
Figure 61:
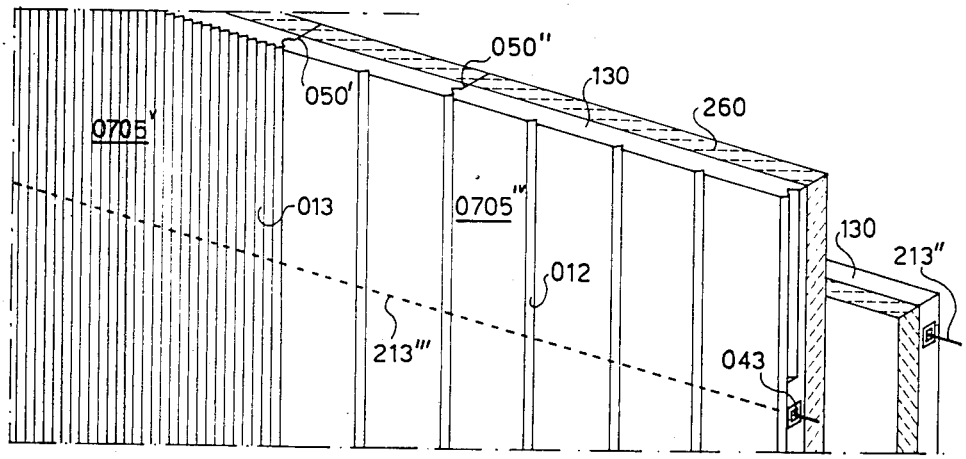
Figure 62:
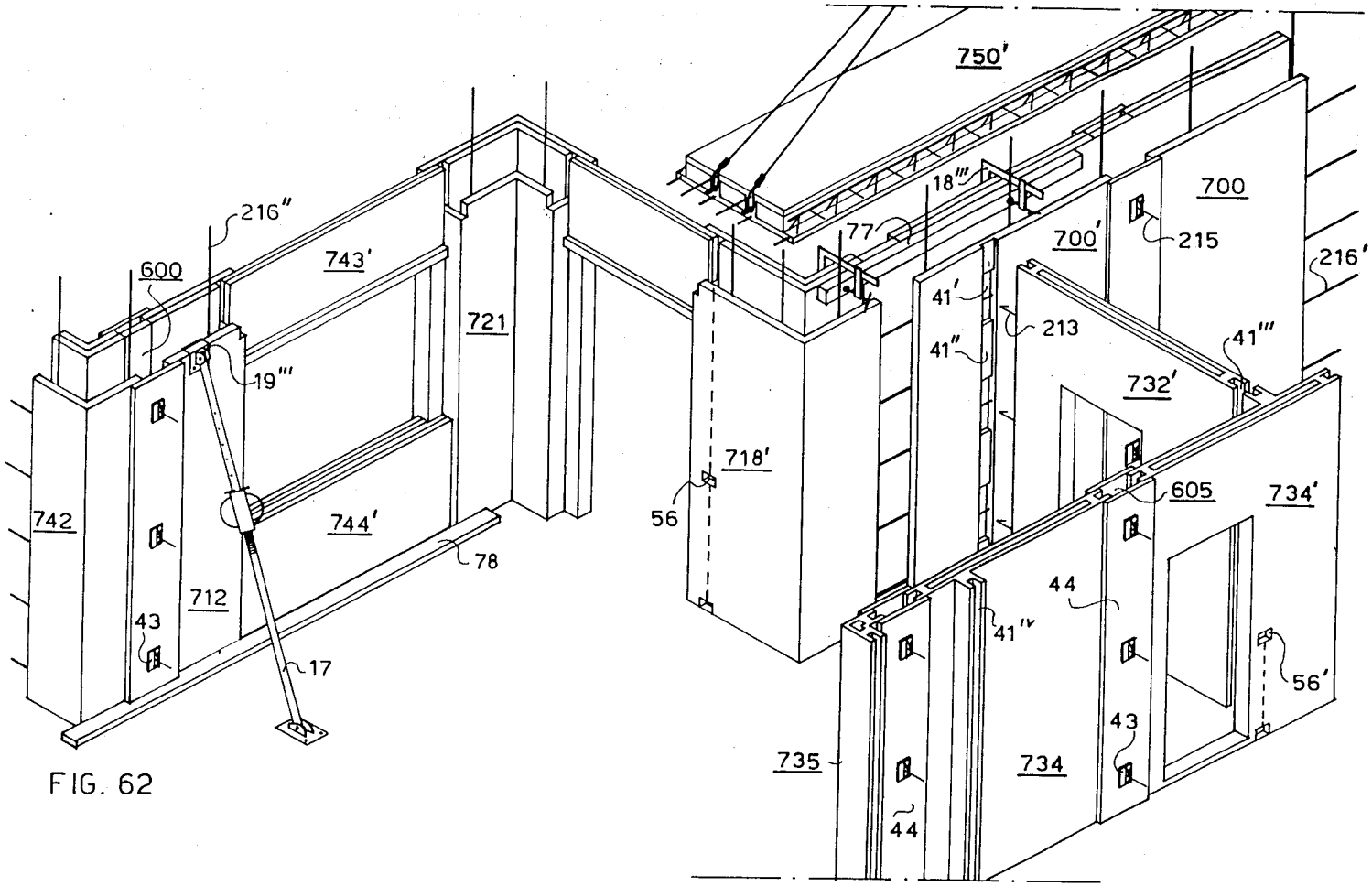
Figure 63:
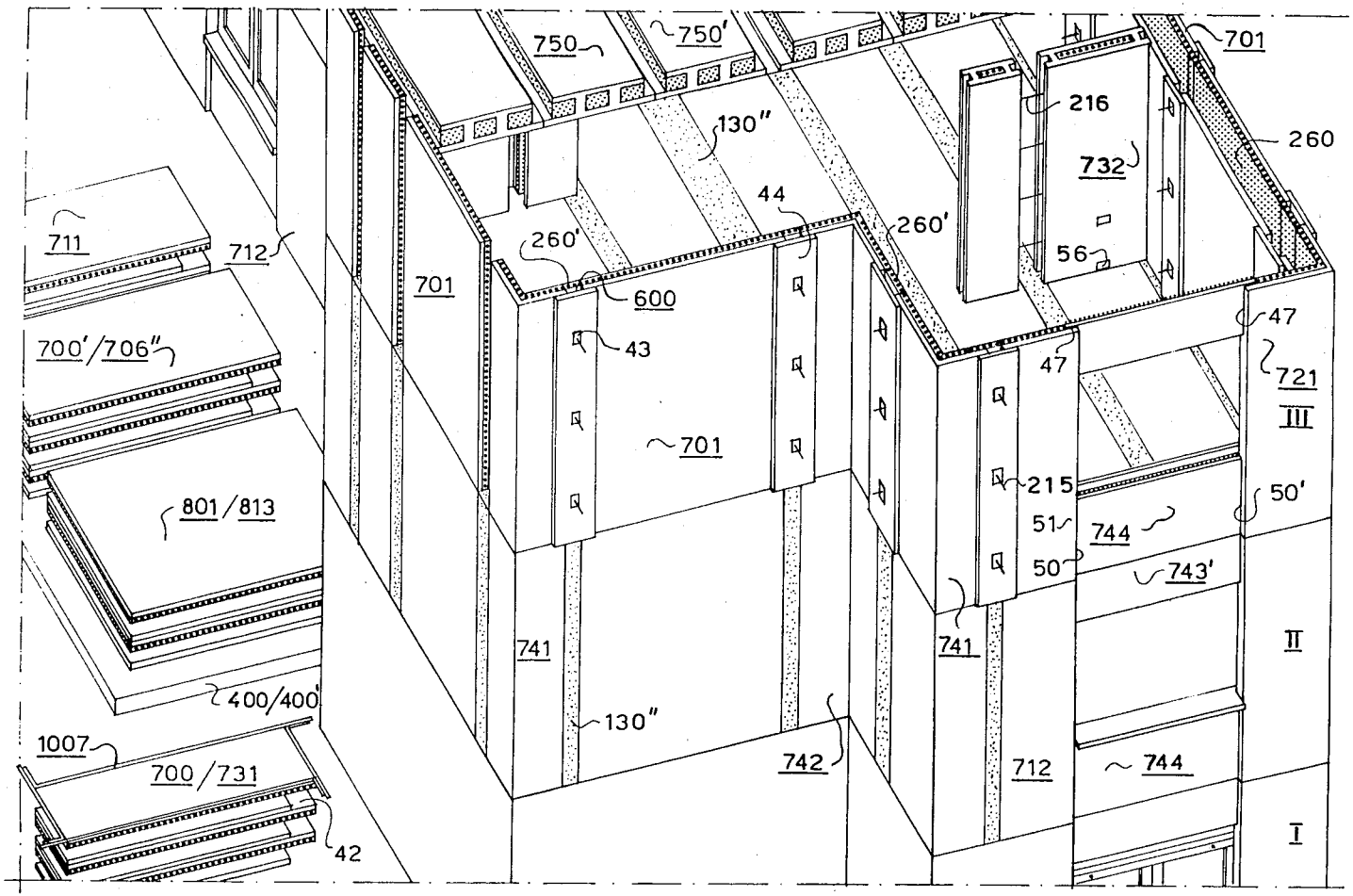

FIG. 5 is a longitudinal sectional view showing the continuous working plane of the apparatus according to FIGS. 3 to 7, in which the L-formed heads 351 are shown, having the function of limiting the castings 130' to a shorter size than the castings 130 and fixing a precise level by means of outfits 38-38' for the prefabricated insulating panel 260 which has been reinforced at 214''; supporting bars 29 to 29''' are also shown, FIG. 6 is a cross-sectional view of an apparatus 1004, similar to that of FIGS. 3 to 5, but with side boards of substantially L-section 308 for the manufacture of double slab floors 750;

FIG. 7 is a general perspective view of the apparatus 1005 shown in FIGS. 3 to 6;

FIG. 8 shows a transportable compound apparatus 1006, for the manufacture with total dimensional variability of the moulded insulating prefabricated elements shown in FIG. 37 at the left side and in FIG. 37A at the right side, as well as the building elements of FIGS. 27, 28 and 45; it allows the manufacture both in a factory and directly in a building yard of the hollow building elements of the series 700 (FIG. 36) to 731;

FIG. 9 is a horizontal sectional view of FIG. 8 showing sliding and positionable bars providing dimensional variations in width and thickness of the elements to be manufactured;

FIG. 10 is a vertical sectional view of FIG. 8 showing the manufacturing apparatus 1006 (FIG. 8) and a blocking mechanism 0900-0900' (FIG. 8) capable of supporting the reinforcements by means of adjusting rods 030. These reinforcements are bound or molded with double insulating panels directly in the vertical gaps; the device 0319 allows the variation of all the dimensions of the insulating prefabricated building elements;

FIG. 11 is a perspective view showing a variable composite apparatus 1007 comprising superimposed frames for the manufacture one over the other of the hollow building elements;

FIGS. 12 and 13 are cross-sectional views taken along line A—A' of FIG. 11;

FIGS. 14 and 14A are longitudinal sectional views taken along line B—B' of the apparatus 1007 shown in FIG. 11, in which a prefabricated element 700 is shown;

FIG. 15 is a perspective view of the manufacturing apparatus 1008 made up of rods and bars 350, 355. This figure also shows preshaped molded and slotted reinforcements as well as two insulating rigid panels incorporating said reinforcements. This apparatus is capable of manufacturing hollow building elements both individually or in pilled up form, as shown in FIG. 11;

FIG. 16 is a perspective view of rods and bars which is a variant of the reticular reinforcements; it shows details of the rod 352 having a levelling plate 1 on the surface 705' in order to carry out the finishing of the slab 130 so as to be parallel to the surface 130';

FIGS. 17, 18 and 19 are views showing additional moulded outfits for securing and spacing apart at the desired positions the insulating panels, the lattice reinforcement 212, rods 350' or 350'' so as to carry out the formation and levelling of the finishing slab surfaces 130-130' (FIGS. 15, 16);

FIGS. 20 and 21 show in a cross-sectional view the building elements 732''-732''' manufactured with the aid of equipment 1009 (FIG. 20) together with the rods or bars 350–352. They also show how the joint is made in 603';

FIGS. 22–22A show in a cross-sectional view how the floor element 750' is obtained by the equipment 1009 of FIG. 20. The rods and bars 351 or 352 anchored in the prefabricated member $266^{IV}$ are used for the formation of the slabs 130-130', avoiding the use of working planes 400;

FIGS. 23 to 31 are sectional views showing insulating building elements for walls having perforated aeration elements, reticular reinforcements of different type to show how single-room, twin-room or prefabricated elements are manufactured; they also show the connecting joints which allow the adaptation of the building elements to the actual dimensions of the building to be erected;

FIGS. 32, 33 and 34 are views showing the building elements provided with double rabbets for the rapid assembly of the window and door frames, openings 46 for anchoring the reinforcements through the insulating panel;

FIG. 35 is a cross-sectional view showing a mould 101 in which a portion of reticular longitudinal lattice 214 is positioned, before the insulating resin is injected or sprayed;

FIGS. 35A and 35B show in cross-sectional views compound equipment for the manufacture of foamed insulating panels incorporating the reinforcements;

FIG. 36 is a cross sectional view showing the positioning in the manufacturing apparatus of the mold prefabricated element 806 of FIG. 36 and how the insulation $206^{V}$ is embedded in the abutments between the two portions;

FIGS. 36A, 37 and 37A are cross-sectional views showing adjustable compound equipment for varying the dimensions of foamed, insulating prefabricated elements, previously connected with reticular reinforcements and perforated metal supporting sheets for obtaining either a two chamber building element 809 (FIG. 36A) or a chamber double insulated building element 810 including a corner with rabbet (FIG. 37) or a double insulated building element 811 with one grid reinforcement;

FIG. 37B is a cross-sectional view showing the manufacture of previously foamed, insulating solid or nearly solid prefabricated elements, thoroughly bound to the surface reticular inner reinforcements. This figure also shows the guide holders 357'';

FIG. 38 is a vertical sectional view showing the prefabricated insulating building element 813 having incorporated reinforcements; this figure also shows the application of rods and spacer devices 1 for positioning the outer linings;

FIGS. 39 and 41 show examples of the manufacture of straight (90°) and inverted (270°), reinforced and insulated, outer corner hollow elements;

FIG. 40 is a cross-sectional view of the building element 740, comprising a T-connection capable of providing the rapid connections with the standard building elements;

FIG. 42 is a perspective view showing at 41' and 41'' the connection of an outer wall with an inner hollow wall;

FIGS. 43 to 50 are perspective views showing the insulated hollow building elements with offset surfaces and side abutments, incorporating corners, rabbets, casting limiting diaphragms, such as FIG. 46, shaped elements 810' (FIG. 45), where L-shaped (FIG. 49) and T-shaped (FIG. 44) connecting elements are shown;

FIGS. 51 to 54A are perspective views showing the assembly of the building elements provided with the window and door openings; they also show how the elastic joints are made at the zones 50-50' (FIG. 52, 51,51' of FIG. 53) concealed in the abutments 51-51', FIGS. 55 to 57 are sectional views of vertically mounted hollow single-room walls 701–706 (FIG. 56) with one insulating layer or two insulating layers; these figs. also show floor building elements 750 with their static connections, the filling of continuous concrete 130'', the ventilation ducts 6, 6', the horizontal connecting chambers 12 for the air convective motion, the inlet opening 12', the outlet opening 12'', the transparent protective tape 12''', the drainage abutment means at 7, and the vapour barriers at 11;

FIGS. 58 and 59 are perspective views showing the joints between the hollow building elements, the system 609' (FIG. 58) providing a concealed clamping between two completely approached elements, the system 609 with visible slots 21 which have to be filled in with plaster or the like and system 600 (FIG. 59) providing at the building yard for the dimensional variability required by the design;

FIGS. 60 and 61 show an assembly made on site and/or on the building itself of building elements having through holes in the slabs and tie rods firmly clamping said elements. The front or visible surfaces have various patterns and connecting shaped abutments 050', 050'';

FIG. 62 is an exploded view showing the practical assembly of the prefabricated building elements, completed with all of the dimensional variabilities and arrangements required by the design; and FIG. 63 is a perspective view showing a sequence of elements mounted on a plurality of superimposed floors.

Figure 1:
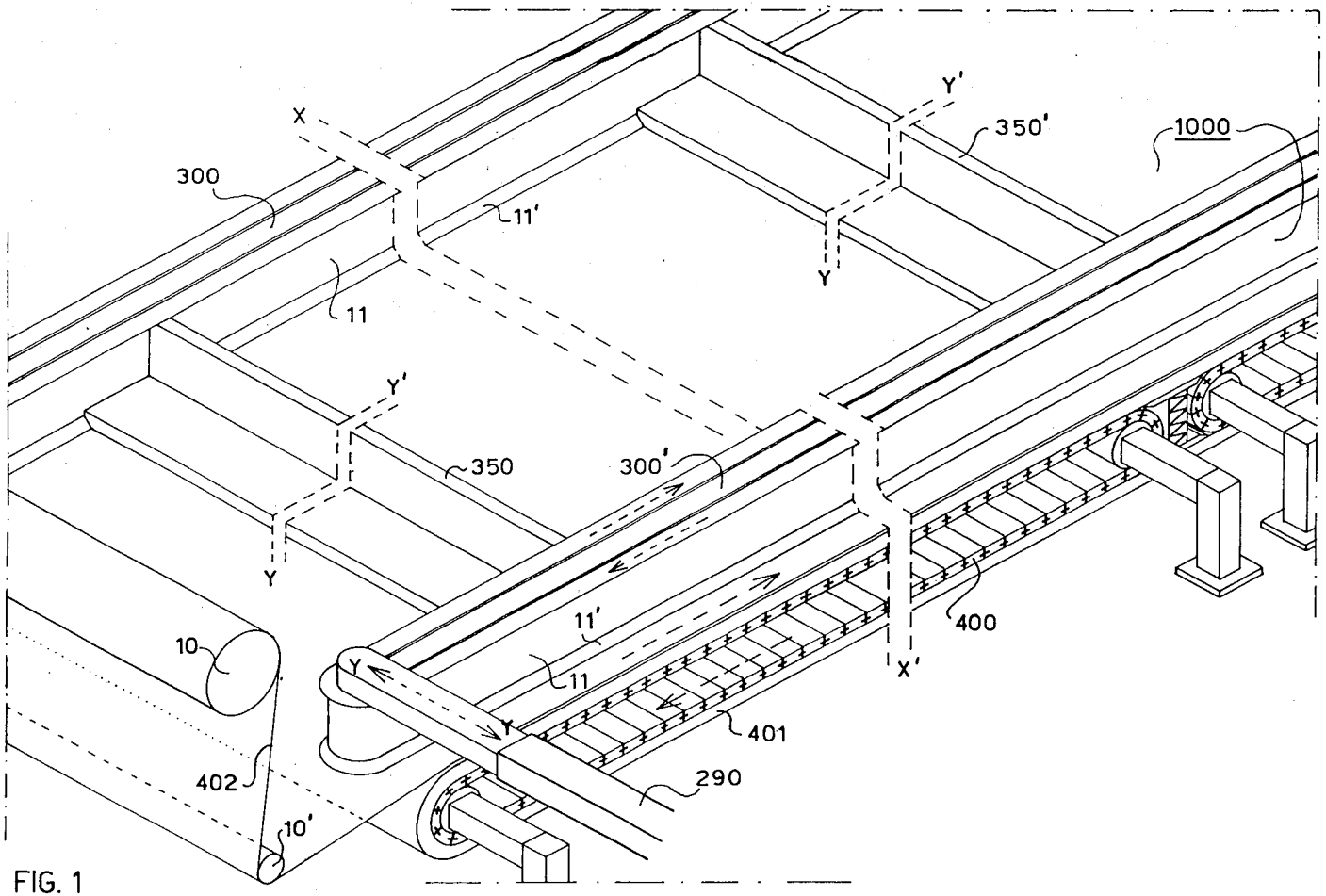
FIG. 1 shows an automatic apparatus 1000 for the continuous manufacture of the building elements of the type 700 (FIG. 47)
Figure 2:
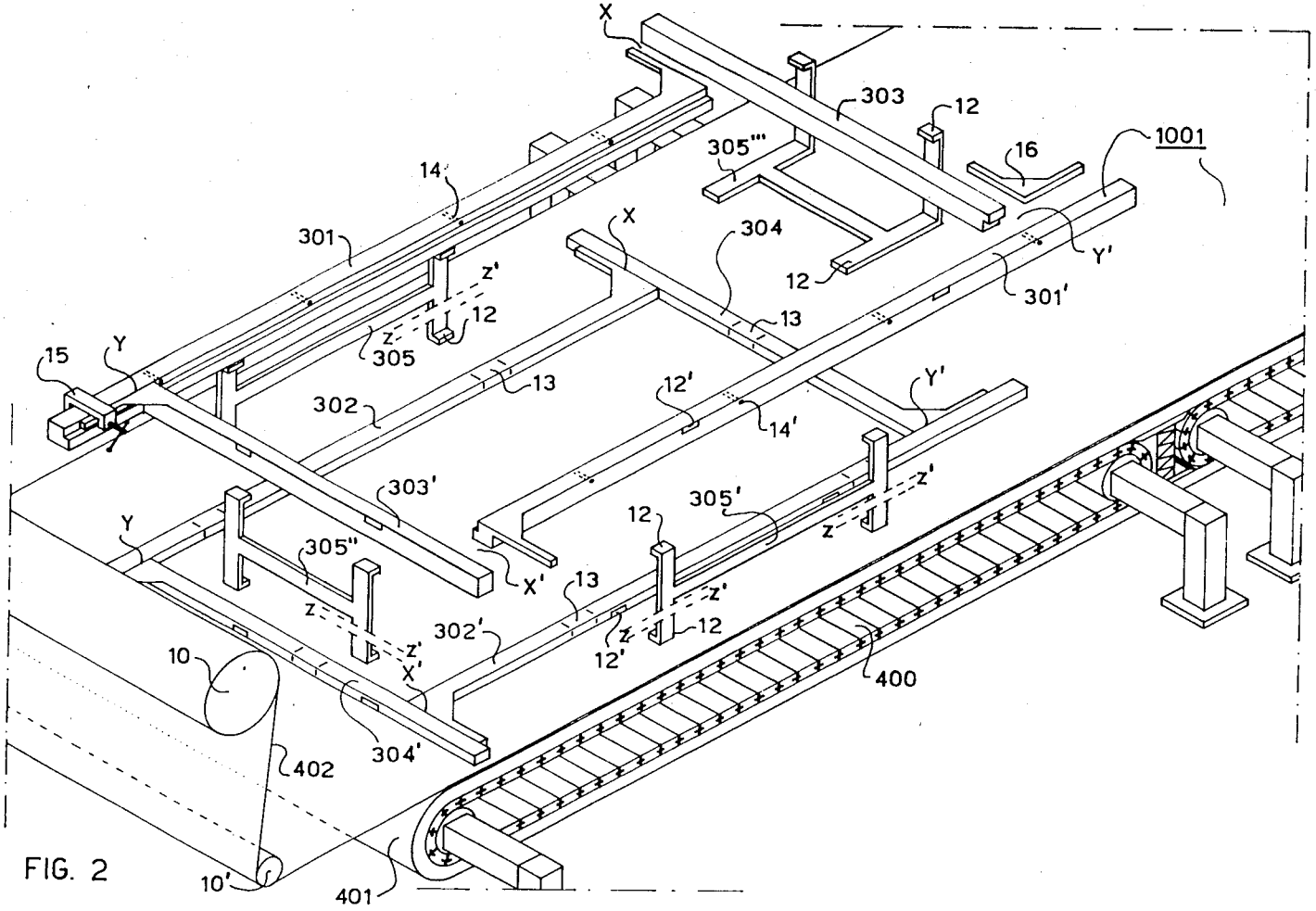
FIG. 2 is an exploded view showing another apparatus 1001 and having the assembly system formed of compound frames.

The automatic apparatus for the manufacture of building elements shown at 1000 in FIGS. 1 and 2 comprises a continuously moving working surface 400, with a belt 401 comprising a flexible disposable sheet 402 unwinding from the spool 10. This has the purpose of facilitating the separation of the finished building element and avoiding the soiling of the work surface.

Two longitudinal boards 300 and 300' are provided on the surface 400; they are mounted on pneumatically or hydraulically operated transverse arms 290, allowing enlargement or restriction of the work surface in the direction shown by the dotted lines Y-Y'. A rubber belt 11 with projecting edge 11' is mounted on each of the boards 300 and 300'. Said belts 11, 11' are mounted close to the boards 300, 300' and serve to hold in place the cross pieces 350, 350'. Thus a mould is provided for the concrete castings or slabs 130, 130' (FIG. 5) containing prefabricated elements of FIG. 5; 803, 804 and 805 respectively of FIGS. 32, 33 and 34.

Panel manufacture is provided by synchronously moving the surface 400, 401 and the pair of belts 11, then proceeding to distribute a first layer of concrete 130' (FIG. 5) directly on to the sheet 402. This material is contained at the sides by belts 11 and by the L-shaped cross pieces 350, 350' placed on surface 400.

The reinforcement is placed above this layer of concrete 130'. It comprises grids 212, 212' (FIG. 5) and insulating panels 260 or first prefabricated elements 800 previously completed and prefabricated with reinforcements and insulation in rigid plates making up a unitary body, a shown in FIG. 5.

By vibration, the reinforcements of said prefabricated elements are penetrated to the desired degree in mixture 130' (FIG. 5); then follows the operation of distributing and vibro-finishing the layer 130 which safely rests at a predetermined level on the surface of insulating plates 260, previously supported by the reticular reinforcements 214 and 214'' and 29 to 29''' (FIG. 5).

The prefabricated building elements are cured and then automatically dismantled, downstream of the working surface 400, while the belts 11 and conveyor belt 400, 401 are recovered upstream.

Owing to the provision of the disposable sheet 402 (FIG. 1), the flexible belts 11 and working surface 400 are moved back upstream already perfectly cleaned.

The dimensional variations in the work surface are obtained at the locations X-X' and Y-Y' shown by double dotted lines.

FIG. 2 is a perspective view showing a automatic machine, denoted as a whole by reference numeral 1001, for the continuous manufacture of building elements 700 (FIGS. 13 and 14A).

The machine comprises a continuously movable work surface 400 covered with a flexible sheath 401 and a continuous disposable sheet 402 unwinding from the spool 10. By means of a magnet, electromagnet or clamps, a container frame, shown as a whole at 1001, is secured on this surface. It comprises tapered rods or bars 301, 301', 302, 302', 303, 303', 304 and 304', having at least a square end or a detached square piece 16.

Said bars may be assembled with clamps, such as screw, jack or lever clamps 15. The bars 301 to 304 and 301' to 304' form geometrical shapes with the possibility of varying the dimensions in X-X' and Y-Y' as said above. The geometrical shape thus obtained, for example two rectangles, a lower and an upper one dimensioned according to design, will be the containers for the castings or slabs 130-130' (FIGS. 13 and 14A) and first prefabricated elements comprising insulating panels 260 and reinforcements 214. This apparatus allows to obtain in simplified form the insulated prefabricated building elements 700 (FIGS. 13 and 14A) having double spaced apart slabs.

The two rectangular frames (FIG. 2) have connections 305, 305', 305'', 305''' secured at 12, 12'; the possibility of varying the height thereof is at Z-Z'. The connections 305''' have an L-configuration allowing the construction of spaced-apart staggered slabs, one of which is longer than the other.

The dismantling of the cured building elements downstream of the work strip is very rapid, since a tapering of the container frame 901 may be made with inwardly facing walls 7, 8 see FIG. 12, so that it is only necessary to lift the ends of the frame to release the manufactured building element without having to disassemble the frame.

For reuse of the container frames, shown for example at 1001 in FIG. 2 and 1007 in FIG. 11, it will be sufficient to move back said frames upstream of the work strip. These frames will be automatically attached to surface 400 by means of the magnet device 13 (FIG. 2) or by clamps.

The tapered bars forming the container element 1001 (FIG. 2) and 1007 (FIG. 11) are marked in order to facilitate the assembly operations. They are provided with slots at 14-14' (FIG. 2) for the passage of the auxiliary connecting irons, such as 21' (FIGS. 23 and 59).

Figure 48:
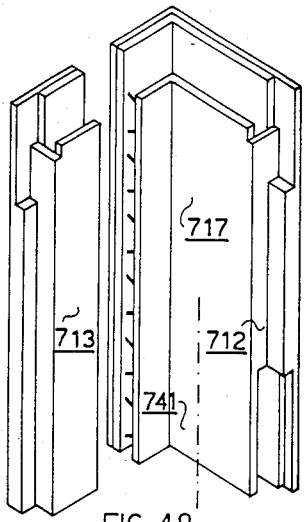
Figure 49:
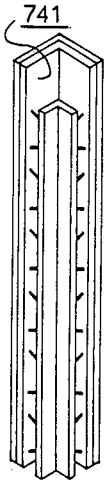
Figure 50:
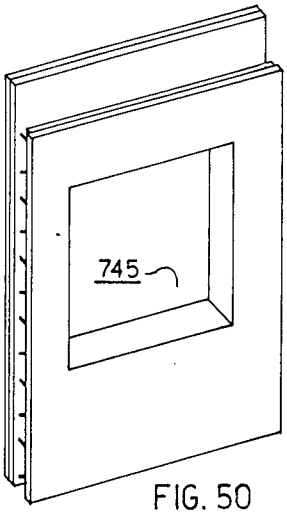

FIG. 3 is a general view showing pneumatic or hydraulic handling equipment 1002, which is made for the manufacture of building elements 700 (FIG. 47) 713 (FIG. 48). This equipment comprises a working surface 400 with C-shaped arms 311 positioned at both sides of the working surface. These arms 311 are slidable on sets of wheels 36 (FIGS. 2 and 4) by means of pistons and cylinders 35, 35' and have just the task of controlling and stopping the side boards, such as 314 and 316 (FIG. 3), at the desired position by operating the valve control on the general board or panel.

The series of pistons and cylinders 34, 34' (FIG. 3) are pivoted at 24'' and perform the task of tipping over the containing side boards 314, 316 and blocking them at the desired position perfectly close and vertically with respect to said surface 400.

Piston devices 35', 35'' are converted at the L-shaped crosspieces 352 and 909 which are operated by control levers to allow length variation X-X' of the building elements being produced.

The crosspieces 352' may be secured to surface 400 with possibility of tipping over around $24^{IV}$. In this case, the dimensional variability X-X' is directly obtained on the side boards with the additional elements 315.

The containing crosspieces 909 consist of fixed elements 353, 354 and 355 to be assembled with the rods 70, 70' and 71, 71' to obtain at 23 all of the dimensions required at Y-Y' and Z-Z'.

The side boards 314 are laterally closed with a rabbet configuration and are interchangeable, the side boards 316 are open to provide open side building elements and allow at 53 the variation in thickness of the elements produced at Z-Z'.

After forming the required geometrical shapes, the pistons are blocked and the concrete mix 130' (FIG. 7) is distributed. By vibration the reinforcements such as 214 are inserted, such reinforcements comprising the insulating panels 260, and the lattice reinforcements 212, the whole previously prefabricated with the reticular connecting reinforcements forming a first prefabricated element 800; the upper concrete mix 130 (FIG. 4) is cast and rests at the exact level on the insulating panel 260. The surface is vibro-finished, and, upon completion of curing which may be accelerated by heat, the prefabricated building elements are dismantled.

FIG. 4 is a cross-sectional view of a semi-automatic pneumatically or hydraulically controlled equipment, shown at 1003, which has a variant of the devices shown at 1002 of FIG. 3.

In this embodiment, the side boards 310, 310' are pivoted at 24''' and attached to arms 311, 311'. The pistons and cylinders 34, 34' pivoted at 24'' block the side boards 310, 310' on the working surface 400 and further allow the rotation thereof. The pistons and cylinders 35, 35' operate as described above and allow variation in the width dimension of the building elements to be manufactured.

The side boards have passage holes or slots at 25 to allow the positioning of the connecting irons 213 which provide the adjoining joints between the building elements.

FIG. 5 is a longitudinal sectional view of a continuously operating work surface 400; crosspieces 351, 351' are provided. This particular L-configuration 39 has the function of restricting the dimension of the concrete castings 130' with respect to the surface castings 130. These crosspieces further provide an accurate support by means of flanges 38, 38' giving a correct level to the insulating panel 260, previously preassembled with the reticular reinforcement.

The level and supporting bars 29, 29', 29'' and 29''' may be of different shape and size. They may pass through the containing side boards, such as at 30 (FIG. 4) and may be recoverable or anchored and left in the reticular structure of the reinforcement elements for example 29'''.

The invention enables an accurate level to be given to the insulating panel 260 and concrete mix 130, and allows variation in the dimensions of the elements at Z-Z', X-X' and X''-X'''.

FIG. 6 is a cross-sectional view showing a semi-automatic device 1004. It has containing side boards 308 with inverted L-shape for the manufacture of the load bearing floor slabs 750. Said boards thus configurated allow a reduction in the widths of concrete 130 with respect to concrete 130', thus maintaining the reinforcements 214 free of the castings. The interspaces thus provided allow further castings on the building yard forming firmly bound horizontal continuous flitches. Further irons and auxiliary connection devices, thoroughly bound with the irons 213 and 40 coming out of the sides of the building elements may also be provided.

FIG. 7 is a general view of manual equipment 1005 for the manufacture of building elements. This equipment comprises a continuous working surface 400 provided with bars 20, 20' having an undercut 2, 2', allowing the fastening of the base crosspieces 307 by means of lever 22; said crosspiece blocked to the side bars 20 determines the thickness and desired dimension of casting 130'. The levelling bar is freely operatable and can discharge the excess of concrete into the subsequent building elements, whereby such an operation is highly facilitated.

Holes 30 allow the passage and support of bars 29 at any position. The boards 306, 306', which tip over, rotate about 24. The left side board is lifted to close the work surface, whereas the right side one is shown open, that is lowered.

This figure also shows the fork 23, which is connected to the base crosspiece 307. The retaining toe with clamp 18, engages at 27, 27' the crosspiece 351 to the boards 306, 306' giving accurate dimension to the equipment.

FIG. 7 further clearly shows the first prefabricated element 800, comprising reticular reinforcements 214, insulating panel 260, which is firmly assembled to the reinforcement lattice 212, 212', the whole prefabricated off site ready for penetration into the lower casting 130'.

FIG. 8 is a perspective view showing the equipment for the mechanical, pneumatic or hydraulic handling 1006. The equipment is of a transportable container type, for vertically manufacturing prefabricated insulating panels of the series 800 (FIGS. 7 and 26) 809 (FIG. 36A) and 810 (FIG. 37) and elements 700 (FIGS. 23 and 47) having surface slabs 130, 130'. The assembly 0900 (FIG. 8) has a framework 0402'' with supports 055 that can be withdrawn from the horizontal platform 0402. The equipment 1006 comprises central vertical walls 0400, lateral vertical walls 0401, 0401', which can be moved so as to be nearer and further away from a central wall 0400. This equipment 1006 also comprises inner vertical defining bars 0312 sliding in adjustable guides 032 (FIGS. 9, 10) and provided with apertures for the passage of the horizontal bars 030.

Said containing bars may be assembled at the ends, as shown at 0315 of FIG. 8.

The assembly 0900 comprises adjustable horizontal supporting bars 030. These bars 030 can slide and pass through the whole length of said walls 0400, 0401, 0401' and vertical bars 0312 by means of the driving members 085.

The assembly shown at 0615 comprises a framework slidable on guides 0402', powered to operate a cylindrical brush rotating within the work walls.

FIG. 9 is a cross-sectional view showing the vertical distribution device of the vertical bars for allowing variation in dimensions of the elements in width Y-Y' (FIG. 8), and has continuous cavities at Z-Z' for the horizontal handling of the set of bars 030 (FIG. 8).

FIG. 10 is a vertical sectional view showing a part of the equipment of FIG. 8, 0900, with the insulating panel 810 manufactured by foaming. Then casting of concrete 130, 130' is carried out in the same equipment for providing the building elements 705.

Provision is also made for guides 032, wheels 033 anchored to the bars 0312, displaceable walls 0400 and 0401, which, along with the rack and gear wheel device 056, allow variation in height X-X' and thickness Z-Z', Z''-Z'''. These variations are obtained by means of bars 030 with the central piston device 045, 045'. The operation of the assembly shown at 1006 is as follows (FIG. 8).

The containers are positioned at the use zone; from the plateform 0402 the compound structure 0402'' is extracted, adjusted and brought level, the units 0900 are withdrawn and brought out for the entire stroke. Then the walls 0401, 0401' are opened and the dimensions are adjusted by the vertical bars 0315. The surfaces 0319 (FIG. 10) are adjusted and the reticular reinforcement 214$^{V}$ is placed together with the surface reinforcements, such as 218, in the previously defined portions. Upon operating the control platforms 0401 are closed and device 0900 comprising the series of rods 030 penetrates in the platforms; the valves for opening pistons 045 are actuated. The insulating raw materials are placed and expanded in the chambers thus formed.

The walls are set apart to the desired degree and by means of suitable pumps. The concrete mixtures are vertically distributed and compacted by means of vibrators.

Upon settling, in this case accelerated, the assembly is dismantled and cleaning operations are effected by the system shown at 0615.

A set of equipment 0400, 0401, 040' can be used for the manufacture of foamed insulating prefabricated elements combined with the reinforcements, and a further set for the concrete casting 130, 130'.

FIG. 11 is a perspective view showing a series of superimposed moulds 1007. This compound equipment comprises tapered bars 301, 301', 302, 302', 303, 303' and 304, 304', having at least one square end or a detached square piece 16. Said bars 301 to 304' may be assembled with clamps 15 and are characterized by forming a geometrical shape with the possibility of varying the dimensions of the mould at X-X', Y-Y'. Said frames will be assembled with the connections 305, 305', 305'', 305''', the latter having an L-shape to enable the manufacture of spaced apart building elements with lateral staggered surfaces of different dimensions.

FIG. 12 is a cross-sectional view taken along line A-A', showing how all of the building elements are obtained using this equipment. The manufacturing process shown here has the advantage that panel manufacture is carried out with the possibility of varying the dimensions of the elements, in accordance with design requirements, using equipment that can be manually operated, owing to the lightness of the frame. The frameworks 1007 (FIG. 11) may be used one above the other, just as shown in FIG. 11, with the interposition of a spacing sheet 42 (FIG. 12) on the surface of the finished concrete 130. This surface may be used as work surface 400 for the series of elements to be manufactured, as shown at 700, directly one above the other. FIG. 63 shows series of superimposed panels 700 to 731, directly manufactured on site at the position of use of the equipment in FIG. 11.

FIG. 12 also shows the bars 301, 302 with a tapered shape at 7 and 8, allowing simple dismantling of the prefabricated building element. For dismantling it is only necessary to manually lift the sides of the compound frame without any disassembling operations.

The box-like shaped bar 41 secured to the work surface provides apertures 41' (see FIG. 42) and cavities or slots 41''. This enables perpendicular connections between the hollow elements being produced. Also in this case, dimensional variations can be effected at Z-Z', Y-Y'.

The bars 301' and 302' (FIG. 13) have a different configuration comprising clamping or connecting elements 18'' (FIG. 13) which clamp the equipment to the surface 400 (FIG. 12).

FIGS. 14, 14A are cross-sectional views taken along line B-B' of FIG. 11 showing the bars 303, 304' connected by 305'', and 303 with 304 connected by 305'''. This last element is characterized by a staggered configuration for obtaining a different slab dimension 130 relative to 130'. These figures also show the separating sheet 42 and the panel of the series 700, as well as how the latter is manufactured.

The variations in dimensions may be effected at Z-Z' and X-X'. The use of insulating prefabricated elements of series 800 to 812 is required for the manufacture of the prefabricated elements of the series 700 to 731 according to the above system described in FIGS. 11 to 14A.

FIG. 15 isometrically shows with 1008 the apertured mould reinforcements 224 assembled with hollow light bars 353''' forming a compound frame. This structure 801 has connecting elements 354' perforated at 31, 31' permitting the positioning of the reinforcement irons 216', 216'' hook connections 219' and straight connections 222' for assembling the insulating panels 260, 260' and reinforcement lattice 212, 218, 218' (FIG. 16) to the structure.

The prefabricated element thus made is capable of receiving the anchoring of the retaining frames 350, 352, 355 performing the functions of containers and levelling tongue for the manufacture by vibro-finishing bars of the series of double insulating plate single-room building elements 705'', both individually and in piled up form as shown in FIG. 11.

FIG. 16 shows as an unrestrictive example different reticular reinforcement irons 214, 214'', 214''' and bars 352 with a levelling tongue placed on plane 705' so as to allow the surface finishing of concrete mixture 130 parallel to the surface 130'. The bars 350, 355 (FIG. 15), 352 applied at the ends of bars 353'' and 353''' also allow the containment and levelling of the insulation 260''' and 260$^{IV}$, cast or foam sprayed onto the perforated continuous ribbed support 218 to the desired thickness. Said double insulating layer comprises the surface reinforcements 212, 212' clamped or connected at 219' (FIG. 15) and provides a bearing plane for the horizontal laying of the finishing concrete mixtures 130, 130' or the vertical direct application of the plaster layers 130''' (FIG. 45).

FIG. 17 is a cross-sectional view showing a mould accessory element 500 comprising a cylindrical hollow body 357 with two plates 358, 358' acting as support surfaces, for establishing the correct level of the insulating panels 260. The ends of the hollow body have screwed or secured thereon by means of pins the small projections 359, 359' with a wide support base for the insulation and with guide bars 350.

FIG. 18 is a plan view showing a disposable spider-shaped moulded outfit 501. It comprises a spider 361 which secures by its central body 359 the parallel spaced apart insulating panels fast with the lattice 212. This outfit has the function of disposable guide holder 350'', secured at 361. The system has the purpose of facilitating the laying and levellings of mixtures 130, 130'.

FIG. 19 is a sectional view showing a mould element 502 similar to that shown in FIG. 17, with the recoverable guide bar 350' in the guide holder.

FIGS. 20 and 21 are cross-sectional views showing a partition element for inner walls, comprising a double slab with an internal insulating core, and grid reinforcements 218 or cage shaped reinforcements 219 with central hole 41. The prefabricated element internally insulated has light rods 353 incorporated and connectors 354, 357 which carry out anchoring of the containing frames 352 or bars 350, 350' which, along with a supporting lattice 218 secured to the reinforcements and insulating material, contain the casting 130 at the desired position.

FIGS. 22, 22A are cross-sectional views showing the double slab load bearing floor element 750' manufactured by the processes described above in connection with FIGS. 20, 21, 21A, by using the moulded insulating compound prefabricated element 266$^{IV}$ reinforced with 353, 353', 354; 214, 218', 218''.

FIG. 23 is a cross-sectional view showing two elements placed side by side and manufactured by the above described process. The elements 700 and 701 of the single-room hollow type have spacing reinforcements 214 incorporating the insulating panels 260 or 262 perforated at 6', and supported by bars 29" (FIG. 24). FIG. 23 also shows how the joint 600 is provided in the building yard, the plates 44' are clamped with jack 43' acting on the outer faces of slabs 130, 130' by means of connecting bars 215. The insulating panel 260" fits in the abutment previously formed in the building element by the side boards 312' (FIG. 24) at 32' and enables continuous insulation to be obtained over the whole surface of the walls to be made.

FIG. 23 also shows the straight or curved auxiliary reinforcement irons 213 for the connection of building elements by means of fastening hooks 217 and a spacer 45 to be incorporated in the concrete which will be cast in the gap. This figure also shows horizontal reinforcement iron 216 for an inner connection.

FIG. 24 is a cross-sectional view showing a hollow type of panel manufactured by the equipment mentioned above 702 with the spacing reinforcements comprising reinforcements 214", the supporting element 29"' for the insulating panel 260, special elements or hollow flat blocks 263 with air ducts 6 cooling and ventilating the outer surfaces. The air ducts 263' are used for heating the inner surfaces. Slabs 130, 130' are also shown with the reinforcements 212.

FIG. 25 is a cross-sectional view showing a two-room building element 704, characterized in that the insulating panel 260 is foamed embedding the reinforcement irons anchored to the lattice structure 214 creating the inner double chambers 5', 5|, which on site can be filled with continuous concrete shown at 130".

The perforated ribbed reinforcements 218 perform the function of reinforcing and supporting the casting 130 (FIG. 26). This is also shown in FIG. 36A at 809. Continuous inner reinforcements 216' integrally block the building elements forming the connection 050.

FIG. 26 is a cross-sectional view showing two adjoining building elements. It also shows how the joint 601 is made at the building yard. The figure shows the position of the insulating panel 260" embedded in the abutment of the insulation 260, the ribbed connecting lattice 218 for the joint imparting an increased strength to the connection between the two components.

FIGS. 27 and 28 are cross-sectional views showing double insulated building elements 705, 706 and 707 manufactured by the described equipment. They also show the use of the prefabricated elements 810 completed with the lattice reinforcements 226, 214"'.

FIG. 29 is a cross-sectional view showing an embodiment of a joint with the interposition of reinforcement irons 221 between two building elements and the connecting reinforcements 216 (FIG. 23) with complementary connections 217. The building elements 709 are made with double air chamber having perforated hollow flat blocks 264, 264' with the interposition of insulating plate material. Such a building element is reinforced by a lattice reinforcement 214 (FIG. 30) and/or steel rods curved at their end, which have the purpose of anchoring the reinforcement lattice at the desired position, so that the concrete slabs 130, 130' form a well connected unitary member.

FIG. 30 is a cross-sectional view showing that the element 710 can be made by the manufacturing equipment 106 shown in FIG. 37B. The figure shows the inner continuous layer of hollow flat blocks provided with air chambers which are firmly assembled to the foamed insulating panel 266. The building element also comprises reinforcements 214".

FIG. 31 is a cross-sectional view showing how the connecting joint is made between two adjoining building elements 711 of full or partially hollow core type, obtained with the equipment 106 of FIG. 37B in a single foamed insulating block comprising the reticular reinforcements and the adjoining ventilation ducts 266', 266".

FIG. 32 is a perspective view showing the zig-zag shaped intermediate reinforcement 214' for the assembly of the rigid insulating panel 262 having slots 46 through which the projecting tops of the reinforcements pass. This invention enables the rapid positioning of large rigid preperforated insulating panels at 46 which are supported at the desired level upon the cross irons 29"' of the prefabricated reinforcement 214'. This further enables the lattice 212 and 218 to be secured to the projecting portion 222 (FIG. 34) above and spaced apart from the insulating panel as desired.

It clearly appears to those skilled in the art that the invention allows assembly of prefabricated elements having the desired dimensions, ready to be inserted in the base casting 130' and capable of supporting subsequent overlying casting 130. The insulating panel can have the inner ventilation ducts 6' throughout the height thereof In addition the building element 715 thus provided has two rabbet elements 47, 47' and 48, 48' having a special side shape. This is useful for rapidly positioning the window or door frame block.

FIG. 33 is a perspective view showing the lattice reinforcement and plates of rigid insulating precut material 266', embedded along the whole length of the reinforcement, the whole prefabricated so as to form a sigle body also comprising the lattices 212, 212'. The element thus obtained is denoted at 804. When used in the above described manufacturing equipment, it allows the manufacture of the compound element 711.

FIG. 34 is a perspective view of the prefabricated element 805 and comprising double spaced apart insulating panels preperforated 46, 46'; the tops of the projecting reinforcement have hooks 222 for assembling with the reinforcement lattice 212. The insulating panels 260', 262 rest at the desired level on the cross irons 29"', $29^V$, assuring a stable support for the slab 130 so as to manufacture panels 706, comprising a double spaced-apart slab of concrete with a double insulating panel.

FIG. 35 is a cross-sectional view showing a portion of intermediate reinforcement 214 positioned in a mould 101 in which insulating resin 261 is injected or sprayed and which by expanding matches the double abutment shape of the mould, the whole being thoroughly bound to the longitudinal reinforcement 214 and supports 29"'.

FIG. 35A is a sectional view of compound equipment 102 having movable surfaces 406, 407, movable bars 030 and adjustable side parts 296 for the manufacture of the foamed insulating panels 261', directly incorporated and firmly adhering to the reinforcements, such as 220', and lattices or perforated supports 218 acting as casting or plaster holder reinforcements; the whole incorporated in a single piece for forming the finishing slabs 130, 130' and assuring dimensional stability of the prefabricated element shown at 807. The element thus made is required for the manufacture of the insulating single-room building elements.

FIG. 35B is a cross-sectional view of a manufacturing equipment similar to that of FIG. 35A with the variant that the structure of the longitudinal reinforcement comprises a perforated pressed metal sheet 226'.

FIG. 36 is a cross-sectional view showing the positioning in the manufacturing equipment of the element 806 prefabricated with the reinforcements 214 (FIG. 35) and lattices 212 and how the insulating element $260^{V}$ is inserted in the abutments of two portions 261. The invention provides a continuous insulating panel acting as solid support of the upper concrete mixture 130 for the simplified manufacture in a single equipment of the building elements of the series $700^{V}$.

FIG. 36A is a cross-sectional view of adjustable compound equipment having dimensional variability, shown at 105, for the series manufacture of the twin-room elements 704 shown in FIG. 25. The equipment enables series production of the foamed insulating element 261″ thoroughly bound to the lattice reinforcements 214‴ and to supporting reinforcements $29^{IV}$, whereas the preforated ribbed casting or plaster reinforcement 218 are spaced apart. Said equipment formed of adjustable walls 406, 407 and movable bars of trapezoidal shape 030′ has pneumatic and/or mechanical handling and allows the manufacture of the above described element by the following process. By operating the opening controls for moving apart the walls 406, 407 and the side boards (not shown), the compound reinforcements are internally positioned, the device is operated for moving the bars 030′ within the chamber, then the walls are closed, the insulating raw material is introduced into the gap, and upon the closure of headstocks, the foaming operation is carried out for providing the required configuration. The whole is then dismantled by opening the headstocks, the walls and extracting the bars.

FIG. 37 is a cross-sectional view of adjustable equipment 104 allowing different dimensions for series manufacture of double spaced apart insulating compound elements 810 foamed so as to adhere to the supports 29‴, lattice reinforcements, such as 214‴, surface reinforcements, such as 218, for the purpose of obtaining with a single process and in a single piece previously reinforced insulating structured surfaces, acting as continuous holder for casting slabs 130 (FIG. 36) and externally as lining or plaster holders. The prefabricated element 810, thus made, is also used in the manufacture of the hollow double insulated single-room elements, such as 722 (FIG. 45), 717, 712 (FIG. 48), 726 (FIG. 46) provided with rabbet corner, as shown also in FIGS. 45, 48, 46′. The manufacturing process for the reinforced insulating element is similar to that described in connection with FIG. 36A, with the variation that the inner bars 030″, 030‴ have pistons 045′ on the center line and at the sides retractable rods 045″ for allowing easy dismantling of the elements. The containing walls 406, 407′ have corner configurations for providing said mould in the foamed insulation whereas the side closing board 297″ has rabbet configuration for providing the required mould in the foamed insulation. The possibilities of varying the dimensions of the element are provided in width at Y-Y′, in length at X-X′ and in thickness at Z-Z′. The insulating surfaces with reinforcements 218 may be stiffened and coated when expanded with front plates or slabs 219, or with fast settling premixed materials or with resins cast on the containing walls, so that they complete their hardening whereupon the expansion step of the insulating material is completed.

The invention enables a hollow manufactured article to be obtained in a single piece with well finished rigid planar surfaces, with all of the reinforcements provided firmly fastened, the foamed element being homogeneous and stiffened; or a prefabricated element insulated and reinforced, with guide holders 3, 2′, 3″ incorporated, ready to be used with the concrete mixture slabs 130, 130′, or directly plastered at the building yard.

The product obtained having the function of a disposable insulated first element for containing continuous concrete castings is very light, so that it can be easily transported, ready for use at the building yard in the dimensions and characteristics as required by the design. The above described mechanical equipment, shown at 104, allows the manufacture of single-piece prefabricated elements with dimensions in height to the size required by the design, such as 714, 717 (FIGS. 43 and 48), or which can be assembled along their width, such as shown in FIGS. 60, 61 and 62 and the manufacture of a plurality of superimposed horizontally assemblable pieces, such as shown at 810′ (FIG. 45).

FIG. 37A shows equipment similar to 104, allowing the manufacture of prefabricated elements having different dimensions, for adaptation to the construction design for the manufacture of reinforced insulating elements, shown at 811, spaced apart double moulded foamed elements, thoroughly bound to lattices, such as 214″, or through steel rods, shown at 222″, connected to the continuous supports 29‴ and surface reinforcements, the whole as a solid and well dimensioned body. Said reinforcements have at the top notches or guide holder retaining toes 3‴ or spacer holder toes 1 (FIG. 38) for a rapid coating of the outer surfaces in a horizontal direction between horizontal or vertical planes on site by vibro-finishing bars, or on the building in the form of plaster easily levellable owing to these rods. The same equipment enables the surface lining or coating to be directly carried out in a single piece with the method used in connection with FIG. 37.

FIG. 37B is cross-sectional view showing the manufacture by equipment 106 with variable dimensions of the solid elements 266‴, partially hollow elements 266″, compound elements 266 (FIGS. 30 and 31) with hollow flat blocks or elements. These elements are firmly bound to the lining 219′, to the inner lattice reinforcements $214^{IV}$ and or to surface reinforcements 218. It is also possible to foresee guide holders 357″, $3^{IV}$ for the rapid manufacture of the surface linings. Such solid or partially hollow prefabricated elements are required for the manufacture of the light partition walls 804 (FIG. 33) and 711 (FIG. 31) and of the floor building elements 750′ (FIG. 22). The whole compound element thus manufactured is firmly bound to the incorporated reinforcements.

FIG. 38 is a vertical sectional view showing the prefabricated insulating element 813, previously mould with two insulating panels incorporating the lattice reinforcements, supporting lattices and rod elements 222′, spacer elements 1 are applied to rod elements for providing the vertical finishing castings 130, 130′ between vertical planes 40′, 40″.

FIG. 39 is a cross-sectional view of inverted (270° ) corner element shown at 742, just as it is made in a factory. The work surface 400 containing boards 310, the movable board 318 pivoted at 24, the mould 316 and 315 (FIG. 40), the reinforcement irons 214″, 228, the ribbed lattice 218, the insulation 260′ and the connecting irons 213 (FIG. 40) are shown therein. The element shown may have a rabbet configuration, such as 319 (FIG. 41) at one or both sides.

FIG. 40 shows a T-element 740 having the function of rapid connection for the hollow walls. There are shown in this figure the work surfaces 400, the moulds 315, 317, and the boards 310, the whole of which may be automatized by pneumatic pistons to provide the required dimensional variability and may have prearrangements for side rabbet configurations. The compound element of the reinforcement irons 214, 229, 212 and the insulating panel 260 are shown in this figure.

FIG. 41 is a cross-sectional view of a straight (90° ) corner element shown at 712. This figure shows the special shape of the work plane 403, the openable side board 320 pivoted at 24, the pistons or cylinders 55 enabling the dimensional variability $Y^{IV}$-$Y^{V}$. These pistons or cylinders acting on the mould 319 have a rabbet configuration. FIG. 41 shows, for example, how the reinforcements 214, 230, 213, 212 and 212' and the insulating material in insulating panels 260 are positioned.

FIG. 42 is perspective view showing a series of building elements being assembled and corresponding to the units 700 to 731. It particularly shows the joining system of the outer wall with the inner wall; the building element 700' has a recess 41", through openings at 41', reinforcing irons 231 which are connected to the irons 216 passing in the gap of building element 700. In some cases this solution replaces the T-element shown at 740 of FIG. 40. The continuous concrete distributed at the building yard within the air chamber through the openings 41' produce a sure clamping in an integral unit between the outer and inner walls.

FIGS. 43 to 50 are general perspective views showing insulated hollow elements having well finished surfaces and/or staggered slabs provided with rabbet abutments required for the rapid assembly of the window and door frames. The corners may be incorporated or made as separate corner elements 741. T-connecting elements 740 are also foreseen. Cast-limiting inner walls 726' (FIG. 46) with different vertical composite possibilities are also provided. The whole as shown is manufactured by the compound equipment 1000 to 1013 (FIGS. 1 to 41) and 101 to 106 (FIGS. 35 to 37B).

FIGS. 51 to 54A are perspective views showing the process for rapid erection of buildings, characterized in that the series of prefabricated building elements are placed longitudinally aligned and at precalculated spacings from one another along the designed lines of the walls to be erected. In relation to the vertical direction, the elements are prearranged at the correct positions for forming floor slab seats 750, seats for upper window regions 743, 743', 743" and for the lower window regions 744, 744", seats for the solid elements 746 and seats for the corner elements 721, 741. FIG. 52 shows the cross-section of the insulated hollow element 721 which is resiliently assembled to the underwindow element 744 by means of invisible joints 50, 50' and 51, 51'(FIG. 53) to conceal possible expansions which may occur in the continuous series of building elements forming the facade.

The characteristics of the invention can also be seen in FIGS. 52 and 53 in the resilient joint shown at 50, 50'. The same expedient is used for the single plate underwindow element 743, the hollow twin-plate element 743" and equipped window element 746.

FIGS. 55 and 56 are vertical sectional views showing the process for rapid erection of buildings according to FIGS. 1 to 54A, characterized in that the series of manufactured elements, selected among those described, are placed on one another in vertical and aligned direction to provide the designed multistorey series of the buildings to be realized.

The horizontal and vertical continuous reinforcing irons 216' and 216", respectively, along with the lattice reinforcements 214"', have the purpose of joining the series of superimposed adjoining building elements, producing joints in one piece with the concrete 130" which at the building yard will be cast into the cavity chambers to consolidate the whole series of components making up the facade.

The floor elements 750 and 750' are prearranged at the correct positions shown, providing the horizontal connections with the previously calculated reinforcing irons 40, along with the lattice connecting reinforcements and previously inserted in the building elements.

At the manufacturing stage of the compound elements further characteristics are obtained: that is, the vertical ventilation ducts 6', the horizontal distributing chambers 12 for air convective motion, the inlet openings 12 and 12', the outlet openings 12", the protective transparent tape 12"', the drainage abutments at 7 and the vapour barrier provided at 11.

FIG. 57 is a perspective view of the hollow insulating element 701 with the ventilation devices 262, 12, 12', 12", 12"' just as provided in the factory.

FIGS. 58 and 59 are perspective views showing the realization in factory and prearrangement of the connecting irons 213, 213" for the manufactured adjoining elements.

The system shown at 600 with toes 217 as made at the building yard with plates 44 allows the possibility of varying the dimensions in width required by the design. The insulating panels 260" are cut to size and inserted in the suitable seats.

The system 609' provides the concealed clamping in recesses 21' by means of tie rods 217, whereas the system 609 similar to the former has open front cavities 21 to be sealed.

FIGS. 60 and 61 are horizontal sectional and perspective views, respectively, showing the assembly on site and/or on the building of the compound elements made in factory of the series shown at 0700 to 0744. The two slabs 130, 130' have series of horizontal through holes 213"' allowing the assembly of the components by the continuous tie rods 213" clamped by screwing, as shown at 043. The side ends of the elements have joint abutments 050', 050". The front surfaces may have different spaced apart channel patterns 012 or approached channel patterns 013, with decorative and joint covering functions.

FIGS. 62 and 63 are exploded views showing the practical assembly of the manufactured compound building elements, completed with all the dimensional variabilities provided in the factory and at the building yard and the inner and horizontal arrangements required by the designs. The standard components, the particular pieces, the straight (90°) and inverted (270°) corners, the rabbets and elements placed under windows are prearranged in adjoining and/or spaced apart alignment along the line of the designed wall, interconnecting the elements by means of pairs of opposed bands 44 and closing the interspace between one element and the next by means of the jacks 43. Said connections carried out only at the edges allow wide possibilities of variations in dimension at the joints. The manufacture of the solid prefabricated elements, provided by the devices 106 (FIG. 37B) in the desired dimensions and thickness and having the surfaces previously well finished, allows the open air inner distribution of the inner partitions, as shown by example at 732', 734', 735 (FIGS. 62, 63) and the provision of the connecting cavities 41', 41'' and side cavities 41''', the reinforcing irons 213, the T-elements made at 734 and the L-elements at 735, allowing the rapid assembly of all the building elements previously described.

The electric system, such as 56, 56', and the hydraulic sanitary system (not shown) are already provided and applied during manufacturing both in outer hollow elements and in the inner partition elements.

The inner distribution of the continuous concrete 130'' in the cavities thus formed and reinforced with irons 216', 216'', statically joins the whole compound series of elements.

The floors 750' close and join the vertical walls allowing accurate references and perfectly level surfaces for the rapid erection of the successive storeys.

All of this contributes to erection of the building in a practically automatic and flexible way, according to the designed program, which has to be accurately followed during its erection.

This result is clearly seen at the 2nd storey or floor of FIG. 63, whereas the 1st storey has the facade, which has been smoothed only at the joint sectors 130''.

The building erection system according to the perspective view of FIG. 63 shows the characteristic whereby the series of manufactured elements, selected among those described, are arranged on site one on the other, or manufactured on site with the superimposed equipment shown at 1007 (FIG. 11) and spaced apart by sheets 42, or by vertical platform equipment 1006 (FIG. 8), or by the equipments 104 (FIG. 37) and 106 (FIG. 37B).

I claim:

1. Apparatus for the manufacture of insulating building elements including at least one inner insulating panel and two outer concrete slabs and having well trimmed outer surfaces, and reinforcements to space apart the two slabs thus forming a continuous cavity, said apparatus comprising: a working plane, a pair of opposed side boards and a pair of transverse cross pieces positioned on said working plane for molding a pair of concrete slabs in spaced relationship, two vertically spaced rectangular frames defining mold sides and supported by said side boards in superposed parallel relationship, supporting means positioned between the concrete slabs for supporting an insulating panel to define a surface of at least one of said concrete slabs, said supporting means serving as spacer elements, and connecting means extending between the frames for positioning each one of the frames in adjustably spaced apart relationship and at the level of at least one concrete slab and defining therebetween an opening through which reinforcements extending into and between the concrete slabs can be introduced or removed.

2. Apparatus according to claim 1, wherein said opposed side boards each are attached to a pair of longitudinally spaced C-shaped support arms which are supported on rollers, and piston means for moving said side boards toward and away from each other.

3. Apparatus according to claim 1, wherein said supporting means are movable toward and away from each other by pistons positioned between said supporting means.

4. Apparatus according to claim 1, wherein the rectangular frames are formed of L-shaped bars which can be assembled to form a rectangle of variable dimensions, anchoring means for removably anchoring said bars to a working plane, and adjusting means for setting the positions of said bars relative to each other to change the length, width and thickness of a mould defined thereby, as well as to define the distance between the cast concrete slabs, the thickness of an insulating panel and the thickness of the slabs.

5. Apparatus according to claim 4, wherein the inner surfaces of the mould are tapered to permit the mould to be lifted to release building elements formed thereby without disassembling said mould.

6. Apparatus according to claim 4, wherein at least one of the connecting means is L-shaped and includes a leg that extends inwardly of the apparatus to enable the manufacture of building elements having slabs of different lengths and widths, said slabs which are staggered relative to each other.

7. Apparatus according to claim 1, wherein a side of a lower rectangular frame is pivoted relative to the working plane to enable release of the building elements formed in the apparatus.

8. Apparatus according to claim 2, including C-shaped arm means and wherein at least one side board is hinged to a C-shaped arm and is rotatable by pistons having one end hinged to the C-shaped arm and another end hinged to the side board.

9. Apparatus according to claim 1, wherein the working plane includes step means for defining a stepped portion in order to form a corner or a T-connection in the building elements, and said step means includes an adjustable form that is movable toward and away from the working plane.

10. Apparatus according to claim 1, including feeding means for feeding a disposable sheet onto said working plane for use during the operation of the apparatus, said feeding means being mounted perpendicularly to the longitudinal direction and adjacent to said working plane.

11. Apparatus according to claim 1, wherein at least one side board of a rectangular frame includes apertures for receiving reinforcing rods to be positioned within a concrete slab.

12. Apparatus for the manufacture of insulating building elements including two spaced outer concrete slabs and at least one inner insulating panel, and reinforcements extending into and between the concrete slabs, said apparatus comprising:

(a) a working plane for defining a lower surface of a lower concrete slab;

(b) a first rectangular frame positioned on the working plane and including means for defining side faces of the lower concrete slab;

(c) a second rectangular frame positioned in superposed, parallel relationship with said first rectangular frame, said second rectangular frame including supporting means for supporting an insulating panel in spaced relationship to the lower concrete slab and including means for defining the side faces of an upper concrete slab, the insulating panel including a top surface defining the lower surface of the upper concrete slab;

(d) connecting means extending between said first and said second rectangular frames for supporting said second frame relative to said first frame; and (e) supporting means in said frames for supporting reinforcing members to extend within and between the concrete slabs.

13. Apparatus according to claim 12, wherein said rectangular frames are each defined by four mutually perpendicular bars each having a shorter leg perpendicular to a larger leg to define an L-shaped bar, each of the short legs extending along an inner face of an adjacent L-shaped bar and facing outwardly of the rectangle defined by said frames, and clamping means for clamping the shorter leg of one bar to the longer leg of an adjacent bar in a predetermined position along said adjacent bar to define a rectangle of predetermined size.

* * * * *